US009334143B2

(12) United States Patent
Ogawa et al.

(10) Patent No.: US 9,334,143 B2
(45) Date of Patent: May 10, 2016

(54) MANIPULATION APPARATUS, AND MOVEMENT APPARATUS EQUIPPED WITH THIS MANIPULATION APPARATUS

(75) Inventors: Kouji Ogawa, Aichi (JP); Fujioki Yamaguchi, Aichi (JP)

(73) Assignee: GOGOU CO., LTD., Kasugai-shi (JP)

( * ) Notice: Subject to any disclaimer, the term of this patent is extended or adjusted under 35 U.S.C. 154(b) by 0 days.

(21) Appl. No.: 12/919,324

(22) PCT Filed: Jul. 2, 2010

(86) PCT No.: PCT/JP2010/004369

§ 371 (c)(1),
(2), (4) Date: Dec. 16, 2010

(87) PCT Pub. No.: WO2012/001748

PCT Pub. Date: Jan. 5, 2012

(65) Prior Publication Data

US 2013/0105430 A1 May 2, 2013

(51) Int. Cl.
*B66C 13/18* (2006.01)
*B66C 13/44* (2006.01)
(Continued)

(52) U.S. Cl.
CPC ..... *B66C 13/18* (2013.01); *B66C 13/16* (2013.01); *B66C 13/40* (2013.01); *B66C 13/44* (2013.01); *B66C 15/065* (2013.01); *G05G 1/08* (2013.01); *B66C 3/18* (2013.01); *B66D 3/18* (2013.01)

(58) Field of Classification Search
CPC ..... B66D 3/18; B66C 13/44; B66C 13/18; H01H 9/0214
USPC ..... 254/264–266, 273, 275
See application file for complete search history.

(56) References Cited

U.S. PATENT DOCUMENTS 3,552,720 A * 1/1971 McKendrick ..... 254/264
4,944,056 A * 7/1990 Schroeder et al. ..... 5/85.1
(Continued)

FOREIGN PATENT DOCUMENTS

CN 101657377 A 2/2010
EP 2119662 A1 11/2009
(Continued)

OTHER PUBLICATIONS

International Search Report for PCT Patent App. No. PCT/JP2010/004369 (Mar. 1, 2011).
(Continued)

*Primary Examiner* — Emmanuel M Marcelo
*Assistant Examiner* — Michael Gallion
(74) *Attorney, Agent, or Firm* — Withrow & Terranova, P.L.L.C.; Vincent K. Gustafson

(57) ABSTRACT

A manipulation apparatus that directs an operation of a drive device utilized in the movement of an object by changing a turning amount or reference direction of relative turning between a first housing and a second housing, wherein the first housing and second housing are in close proximity to each other along the turning axis of the relative turning, and each comprise an outer peripheral face having substantially the same diameter around the turning axis of the relative turning or having a substantially circular cross section perpendicular to the turning axis of the relative turning at this proximal position or nearby, and an indicator for indicating, in a mode that is visible by an operator, information related to the turning amount or turning direction of the relative turning is provided to each of the outer peripheral faces of the first housing and the second housing.

17 Claims, 18 Drawing Sheets

(51) Int. Cl.

| | |
|---|---|
| ***B66C 13/40*** | (2006.01) |
| ***G05G 1/08*** | (2006.01) |
| ***B66C 13/16*** | (2006.01) |
| ***B66C 15/06*** | (2006.01) |
| *B66C 3/18* | (2006.01) |
| *B66D 3/18* | (2006.01) |

(56) References Cited

U.S. PATENT DOCUMENTS

| | | | | |
|---|---|---|---|---|
| 5,133,465 | A * | 7/1992 | Kalan | 212/285 |
| 5,489,032 | A * | 2/1996 | Mayhall et al. | 212/285 |
| 5,513,886 | A * | 5/1996 | Cyr | 294/66.1 |
| 5,586,158 | A * | 12/1996 | Iwama et al. | 376/268 |
| 5,865,426 | A * | 2/1999 | Kazerooni | 254/270 |
| 6,386,513 | B1 * | 5/2002 | Kazerooni | 254/270 |
| 7,810,791 | B2 * | 10/2010 | DeVos | 254/270 |
| 8,157,113 | B2 * | 4/2012 | Golder | 212/284 |
| 8,465,005 | B2 * | 6/2013 | Givens | 254/93 R |
| 2006/0226106 | A1 * | 10/2006 | Zaguroli, Jr. | 212/331 |
| 2011/0130862 | A1 * | 6/2011 | Gao et al. | 700/213 |
| 2013/0105430 | A1 | 5/2013 | Ogawa et al. | |

FOREIGN PATENT DOCUMENTS

| | | | |
|---|---|---|---|
| JP | 46-26735 | Y1 | 9/1971 |
| JP | S46-26735 | Y1 | 9/1971 |
| JP | 48-32863 | Y1 | 10/1973 |
| JP | S48-35886 | U | 10/1973 |
| JP | S49-083146 | A | 8/1974 |
| JP | 55-57237 | | 4/1980 |
| JP | S59-166496 | A | 9/1984 |
| JP | H01-103278 | A | 4/1989 |
| JP | 1-90791 | U | 6/1989 |
| JP | H01-90790 | U | 6/1989 |
| JP | H01-90791 | U | 6/1989 |
| JP | H3-117589 | U | 12/1991 |
| JP | 4-69175 | A | 3/1992 |
| JP | H09-282904 | A | 10/1997 |
| JP | 2002-329442 | A | 11/2002 |
| JP | 2007-039232 | A | 2/2007 |
| JP | 2007-130485 | A | 5/2007 |
| JP | 4898962 | B2 | 1/2012 |
| WO | WO2008/099611 | A1 | 8/2008 |

OTHER PUBLICATIONS

Written Opinion for PCT Patent App. No. PCT/JP2010/004369 (Mar. 1, 2011).

International Preliminary Report on Patentability for PCT Patent App. No. PCT/JP2010/004369 (Jan. 8, 2013).

Office Action from Japanese Patent App. No. 2010-540752 (Jul. 27, 2011).

Office Action for Chinese Patent Application No. 201080002413.3, dated Apr. 10, 2015, with partial English translation (11 pages).

Office Action (Notice of Reason(s) for Rejection) for Japanese Patent Application No. 2011-108662, mailed Oct. 6, 2015, with English translation (20 pages).

Extended European Search Report for European Patent Application No. 10745520.6, mailed Dec. 2, 2013, 11 pages.

Decision of Rejection for Japanese Patent Application No. 2011-108662, drafted Dec. 17, 2014, 4 pages.

Office Action (Notice of Reason(s) for Rejection) for Japanese Patent Application No. 2011-108662, Appeal No. 2015-4584, Jan. 5, 2016, with partial English translation (16 pages).

Office Action (Notice of Reason(s) for Rejection) for Japanese Patent Application No. 2011-108662, May 1, 2014, with partial English translation (5 pages).

Office Action (Notice of Reason(s) for Rejection) for Japanese Patent Application No. 2011-205205, May 1, 2014, with partial English translation (4 pages).

Office Action from Chinese Patent App. No. 201080002413.3 (Jun. 6, 2014).

* cited by examiner

MANIPULATION APPARATUS, AND MOVEMENT APPARATUS EQUIPPED WITH THIS MANIPULATION APPARATUS

This application is a national phase entry under 35 U.S.C. §371 of PCT Patent Application No. PCT/JP2010/004369, filed on Jul. 2, 2010, which is incorporated by reference.

TECHNICAL FIELD

This invention relates to a manipulation apparatus with which an operator can manipulate the operation of a drive device utilized in the movement of an object, and to a movement apparatus comprising this manipulation apparatus, and more particularly relates to a manipulation apparatus with which an operator can manipulate the direction and so forth of operation of a drive device utilized in the movement of an object by changing the turning amount of relative turning between the housing of a first apparatus element and the housing of a second apparatus element, and to a movement apparatus comprising this manipulation apparatus.

A person who manipulates the operation of a drive device with the manipulation apparatus in the present invention shall be referred to as an "operator." Also, in the present invention, at least part of the people around the operator (within the range of manipulation work when the operator manipulates the manipulation apparatus, within the movement range of an object when the object is moved by manipulation of the manipulation apparatus by the operator, and including a range in which there are people other than the operator who are in danger, or might be in danger, by operation of the manipulation apparatus by the operator) shall be referred to as "people around" the operator.

BACKGROUND ART

As an example of a manipulation apparatus for directing the operation of a drive device utilized in the movement of an object by an operator, there is a known manipulation apparatus with which the operation of a drive device utilized in the movement of an object is directed by having the operator change the turning amount of relative turning between a housing and a slender member that are connected via a rotary connector (Patent Document 1).

With the above-mentioned manipulation apparatus, or a movement apparatus equipped with the same, there is a known example in which the housing of the manipulation apparatus is held in the hand, and a display component is provided for displaying the direction in which the housing is facing, and therefore the movement direction of the object selected by the operator, at a place that is visible by the operator manipulating the movement of the object (such as the housing of the manipulation apparatus that is in the field of vision when the operator glances down at his hands) (Patent Document 2). In this example, if the display component is installed at a place that can be visibly checked by people around the operator (such as the ceiling, a wall, or the like that is in the field of vision when the operator looks at the moving object), then people around the operator also can ascertain the movement direction of the object and thereby avoid danger. Typical examples of this display component include electro-optical signs and direction indicators that display the direction the housing is facing with text, symbols, numbers, arrows, different colors or shades, flashing lights, or the like, but there are no particular restrictions thereon (see Patent Document 2, paragraphs 0082 to 0084, and paragraphs 0226 and 0268).

Patent Document 1: Japanese Patent Application Laid-Open No. 2007-39232

Patent Document 2: WO 2008-099611 A1

In the latter case of prior art (Patent Document 2), it is disclosed that a display component for displaying the direction in which the housing of a manipulation apparatus that is in the field of vision when the operator glances down at his hands is provided to the housing, and that a display component for displaying the movement direction of the object is provided at a place other than the housing of the manipulation apparatus which can be seen by people around the operator.

However, this disclosure is not exactly specific, and no text can be found that teaches or suggests a constitution that takes into account the standing positions, orientation, behavior, etc., of the operator who watches the display component and people around the operator, or a manipulation apparatus that has a compact size and improves manipulation accuracy, or the specific constitution of a movement apparatus equipped with this manipulation apparatus.

Also, although it is disclosed in the latter case of prior art that the display component is provided to the housing of the manipulation apparatus, the display component that is specifically discussed therein is said to compute and display the direction in which the housing is facing and the movement direction of the object on the basis of angle information from an encoder corresponding to the housing orientation (see paragraphs 0266 and 0268, and FIG. 24 of Patent Document 2).

In this case, the presence of an electrical signal processor for performing the computation inevitably makes the configuration of the manipulation apparatus (and particularly the electrical circuits contained in the housing of the manipulation apparatus) correspondingly more complicated, which ends up making the housing larger and less convenient for the operator to use. To make the housing smaller, some special configuration of the manipulation apparatus becomes necessary.

DISCLOSURE OF THE INVENTION

The present invention was conceived in light of the above situation, and it is an object thereof to provide a manipulation apparatus which is easy for the operator to handle, can be formed in a compact size, and can issue precise manipulation directives, and with which the operation of a drive device used in the movement of a crane or another such object can be easily confirmed near at hand at the same time, as well as a movement apparatus comprising this manipulation apparatus.

The manipulation apparatus pertaining to the present invention is a manipulation apparatus capable of directing an operation of a drive device utilized in the movement of an object by changing a turning amount or reference direction of relative turning between a first housing and a second housing, wherein the first housing and/or second housing is provided with an indicator for indicating, in a mode that is visible by the operator, information related to the turning amount or turning direction of the relative turning, around a turning axis of the relative turning.

With this manipulation apparatus, since the first housing is constituted so as to be capable of relative turning with respect to the second housing, when the operator holds the first housing in his hand to perform a manipulation, for example, even if the standing position, manipulation orientation, or manipulation behavior of the operator should impart a twisting force between the first housing and second housing, there will be no change in the orientation of the first housing with respect to the operator, although the orientation of the first housing with respect to the second housing does change. Consequently, this manipulation apparatus is easier for the operator to handle. Also, since the operator only needs to hold the first housing in his hand, the design can be such that parts directly related to manipulation (such as manipulation switches) are installed in the first housing, and other parts (such as a circuit board for signal processing, or electronic devices for detecting the relative turning) are installed as much as possible in the second housing, so a substantially more compact size can be attained. Alternatively, the design can afford a good weight balance between the two housings.

Furthermore, with this manipulation apparatus, since an indicator for indicating, in a mode that is visible by the operator, information related to the degree of relative turning or the direction of turning is formed at the first housing and/or the second housing, the operator can visually check the information indicated by the indicator, and thereby ascertain the amount or direction of manipulation performed by the operator himself or, from another viewpoint, his standing position, manipulation orientation, or manipulation behavior. This makes it easy for the operator to confirm or estimate, by means near at hand, the operation of a drive device used for the movement of an object, or the sense of distance or positional relation between himself, the object, and the drive device, or in some cases the sense of distance or positional relation between himself and other devices, apparatuses, or other such articles in his surrounding environment or people other than himself (people around the operator), and at the same time allows precise manipulation directives to be issued, so that the manipulation can be carried out more safely. In short, using this manipulation apparatus allows the operator to perform his work quickly, reliably, and safely.

As discussed above, the present invention provides a manipulation apparatus which the operator can easily handle, which can be formed in a compact size, with which precise manipulation directives can be issued, and at the same time with which the operation of a drive device used in the movement of an object can be easily and conveniently confirmed or estimated, which in turn allows the operator to carry out his work quickly, reliably, and safely.

The term "turning" as used in the present invention is used in a broader sense than "rotation," and has the same meaning as rotating "forward and backward."

With the manipulation apparatus pertaining to the present invention, the following modes are preferable.

(1) At or near the place where the indicator is provided, the first housing and second housing have substantially the same diameter around the turning axis of the relative turning, or both have a substantially circular cross section perpendicular to the turning axis of the relative turning.

(2) The first housing and second housing are in close proximity to each other along the turning axis of the relative turning, and have substantially the same diameter around the turning axis of the relative turning, or both have a substantially circular cross section perpendicular to the turning axis of the relative turning, at the proximal position or nearby, and the first housing and/or the second housing is equipped with the indicator.

(3) The first housing and second housing are disposed so that the surfaces of each that are perpendicular to the turning axis of the relative turning are opposite and in close proximity to each other, and are substantially cylindrical in form, with substantially the same diameter, at their opposing positions or nearby.

(4) On at least one surface of the first housing and second housing, am indicator for indicating, in a mode that is visible to the operator, the degree of relative turning, or information related to this degree, is provided within at least part of the range around the turning axis of the relative turning at the above-mentioned opposing positions or nearby.

With the constitution of (1) above, at or near the place where at least the indicator is provided, the first housing and second housing have substantially the same diameter around the turning axis of the relative turning or both have a substantially circular cross section perpendicular to the turning axis of the relative turning, whereas with the constitution of (2) above, regardless of whether or not they are at or near the place where the indicator is provided, at at least positions that are in close proximity to each other, or near these positions, around the turning axis of the relative turning, the first housing and second housing have substantially the same diameter around the turning axis of the relative turning or both have a substantially circular cross section perpendicular to the turning axis of the relative turning, so whichever constitution is used, if the diameter is substantially the same around the turning axis of the relative turning, then even if the housings are turned relative to each other, one housing will not cast a shadow on the surface of the other housing, and if both cross sections perpendicular to the turning axis of the relative turning are substantially circular, then even if a shadow is cast on the surface of the housing by turning, the shadow will be uniform, with no difference in darkness or length in the shadow, so a situation in which the information indicated by the indicator disposed on the surface of the other housing surface is difficult to read will either never occur or will be unlikely to occur.

Another difference is that the constitution in (2) above is easier to manufacture than the constitution in (1) above. Also, when the design is such that the first housing and second housing turn relatively within a limited range, either of the constitutions (1) and (2) can be employed, but the constitution of (2) above is not necessary, and the constitution of (1) above is sufficient.

With the constitution of (3) above, even if both housings are turned relatively, one housing will not cast a shadow on the surface of the other housing, and a situation in which the information indicated by the indicator disposed on the surface of the other housing surface is difficult to read will be unlikely to occur.

With the constitution of (4) above, the indication made by the indicator provided to either the first housing or the second housing is visually emphasized by the relative turning of the other housing that is opposite and in close proximity, so the degree of this relative turning, or information related to this degree, can be easily seen by the operator, and will not be overlooked. Consequently, with the present invention, the occurrence of the above problems is either prevented or mitigated, so the operator can carry out his work quickly, reliably, and safely.

It is preferable for the indicator to be provided to both the first housing and the second housing because the visual emphasizing effect of relative turning of the other housing that is opposite and in close proximity will be greater.

Next, the movement apparatus pertaining to the present invention is a movement apparatus that comprises a drive device utilized in the movement of an object, and a manipulation apparatus capable of directing an operation of the drive device utilized in the movement of an object by changing a turning amount or turning direction of relative turning between a first housing and a second housing, wherein the first housing and/or the second housing is provided with an indicator for indicating, in a mode that is visible by the operator, information related to the turning amount or turning direction of the relative turning, around a turning axis of the relative turning, and furthermore, a display component for displaying the movement direction of the object or information related to the turning amount or turning direction of the relative turning is provided at a place within a field of vision of an operator other than the manipulation apparatus, and at least part of the display on the display component changes in synchronization with a change in the indication by the indicator of the first housing.

This movement apparatus comprises a display component that displays information related to the turning amount or turning direction of the relative turning, or the direction of advance of the object, at a place within a field of vision of the operator other than the manipulation apparatus. Therefore, not only the operator, but also people around the operator can see the information displayed on the display component, which means that it is easy for the operator to confirm or estimate the operation of a drive device used for the movement of an object, or the sense of distance or positional relation between himself and the object or the drive device, or in some cases the sense of distance or positional relation between himself and other devices, apparatuses, or other such articles in his surrounding environment or people other than himself, so the operator and people around the operator can carry out their work more safely.

Also, this movement apparatus comprises the same manipulation apparatus as the manipulation apparatus pertaining to the present invention. When this manipulation apparatus is used, work can be carried out quickly, reliably, and safely for the reasons already explained.

With this movement apparatus is used, the operator can carry out his work efficiently, and people around the operator can also carry out their own work safely and efficiently.

Therefore, with the present invention, the operator of a manipulation apparatus can carry out his work quickly, reliably, and safely, and at the same time the operator and people around the operator can carry out their respective work safely (and in particular, the operator will not put the people around him at risk), so a movement apparatus can be provided with which work can be carried out more efficiently.

The terms "indicator" and "display component" are distinguished in the present invention.

The "display component" in the present invention refers to a component that is disposed at a place other than the housing of a manipulation apparatus when an operator uses this manipulation apparatus to move an object by manipulating the operation of a drive device, and that transfers information related to the movement direction of the object, along with other information as necessary, to the operator and/or people around the operator in a mode that is visible to the operator or people around the operator. The display component in the second case of prior art corresponds to the "display component" in the present invention.

In contrast, the "indicator" in the present invention refers to a component that is provided to a housing of a manipulation apparatus when an operator uses this manipulation apparatus to move an object by manipulating the operation of a drive device, and that transfers information related to the direction in which the housing is facing, along with other information as necessary, to the operator in a mode that is visible to the operator.

Just as the terms "indicator" and "display component" are distinguished in the present invention, so too are the terms "indicate" and "display" distinguished.

Incidentally, when text, symbols, numbers, arrows, different colors or shades, flashing lights, or the like formed as information to be transferred is attached at a suitable location on the outer surface of the housing of the manipulation apparatus that can be readily seen by the operator during manipulation work by making use of a method such as engraving, printing, surface working, surface treatment, light emitting element installation, or the like, the information transfer effected by this attachment corresponds to "indication."

The manipulation apparatus provided to the movement apparatus pertaining to the present invention can be favorably constituted as any of (1) to (4) above, allowing effects corresponding to the various constitutions discussed above to be obtained.

Also, the movement apparatus pertaining to the present invention is a movement apparatus that comprises a drive device utilized in the movement of an object, and a manipulation apparatus for directing the operation of the drive device utilized in the movement of an object, wherein the manipulation apparatus and a controller of the drive device are constituted so as to be able to send and receive radio signals or optical signals in a non-contact manner, and a display component for displaying the movement direction of the object is provided at a place within a field of vision of an operator other than the manipulation apparatus.

With this constitution, the exchange of signals between the manipulation apparatus and the drive device is not hindered by an object moving through the work space, an object installed in the work space, foot traffic, or the like, and no complicated routing of cables or the like is necessary. Also, people around the operator near to the crane or other movement apparatus can easily recognize or predict the behavior of the drive device or the movement direction of the object from information displayed on the display component, so the work can be carried out quickly, reliably, and safely.

In a preferred embodiment of the movement apparatus pertaining to the present invention, the drive device comprises an X direction rail disposed in an X direction above the field of vision of the operator, a Y direction rail that is disposed in a Y direction perpendicular to the X direction and moves along the X direction rail, and a trolley that can move along the Y direction rail and can move an object in a Z direction perpendicular to both the X and Y directions, and the display component is disposed on the trolley or the Y direction rail.

With this constitution, since the display component is disposed at a high position within the work space, the field of vision of the operator and/or people around the operator looking at the display component will not be blocked by an object moving through the work space, an object installed in the work space, etc., so the workers can perform their work quickly, reliably, and safely. Particularly when the display component is disposed at the trolley that travels over the Y direction rail, the operator and/or people around the operator can recognize or predict the behavior of the drive device and the movement direction of an object from the display component, which moves along with the trolley, so the sense of distance and the positional relation between a moving object and the operator or people around the operator can be intuitively and easily grasped.

In this case, the X direction rail may comprise a pair of rails disposed in parallel to each other, and the display component may be disposed at a position between the pair of rails.

With this constitution, if the display component is disposed at a position between the pair of rails, the display component will be at the highest position and therefore less likely to be blocked by cargo and objects left in the work space, so the operator and/or people around the operator can easily confirm the direction in which the trolley is travelling when they are near the trolley and furthermore at nearly any location within the work space.

In another preferred embodiment of the movement apparatus pertaining to the present invention, the first housing is provided with at least a button for directing the movement of the object by the trolley in the Z direction, and the second housing is provided with a turning detector for detecting the relative turning, a circuit board for processing signals on the basis of the manipulation of the button and output signals from the turning detector, and a connecting member that transmits the output signals from the first circuit board to the circuit board.

With this constitution, the operator may hold and operate just the first housing, and the design can be such that parts directly related to manipulation (buttons) are installed in the first housing, while other parts (at least a turning detector for detecting the relative turning, a circuit board for processing signals on the basis of the manipulation of the buttons and an output signal from the turning detector, and a connecting member that transmits an output signal from the first circuit board to the circuit board) are installed as much as possible in the second housing, so a manipulation apparatus with a substantially more compact size, or with a better weight balance between the two housings, can be provided, as can a movement apparatus comprising this manipulation apparatus.

Also, when the buttons installed in the first housing are multi-stage switches, or have a waterproof structure, or have a dustproof structure, the space accounted for by these switches will be larger than that with ordinary switches, making it difficult for these buttons to be installed within the confined housing space. However, since parts not directly related to manipulation by the operator are installed in the second housing, this frees up extra space in the first housing. Consequently, with this constitution, even switches that take up a large amount of space can be provided to the first housing, so it is possible to provide a manipulation apparatus with button manipulation that is highly dustproof, waterproof, or functional, as well as a movement apparatus comprising this manipulation apparatus.

Furthermore, since parts that are susceptible to vibration or impact are housed on the second housing side, which the operator holds and does not hold and manipulate, the manipulation apparatus will be less apt to undergo malfunction or other problems if it is subjected to vibration or impact from the outside, as compared to when at least part of these parts are housed in the first housing, where there are more vulnerable to unintentional impact during manipulation, handling, and so forth. Also, with this manipulation apparatus, any malfunctions or problems with these parts can be repaired by removing just the second housing, or the necessary parts can be replaced, so ease of maintenance is excellent. Therefore, with this constitution, malfunctions and other troubles are relatively unlikely to occur, and a manipulation apparatus that is easy to maintain, as well as a movement apparatus comprising this manipulation apparatus, can be provided.

In yet another preferred embodiment of the movement apparatus pertaining to the present invention, an impact reduction member is provided to at least part of the outer surface of the first housing and/or the second housing. With this constitution, a manipulation apparatus that is unlikely to experience malfunction or other trouble if it should be subjected to vibration or impact from the outside, as well as a movement apparatus comprising this manipulation apparatus.

The term "impact reduction member" here refers to a member having the function of making it less likely that impact or vibration imparted from the outside to the first housing and/or the second housing will have an adverse effect on electronic parts installed inside the first housing and/or the second housing. As long as the member has this function, it does not matter what it is called, and therefore any impact-resistant member, impact absorbing material, vibration absorbing material, vibration reducing member, or the like corresponds to the impact reduction member.

In yet another preferred embodiment of the movement apparatus pertaining to the present invention, the first housing is provided with at least a button for directing the movement of the object in the Z direction by the trolley, and a first circuit board that processes signals based on the manipulation of the button in order to reduce the number of signal lines for outputting the signals to the second housing side, and the second housing is provided with a turning detector that detects the relative turning, a second circuit board for processing output signals from the turning detector and output signals from the first circuit board, and a connecting member that transmits the output signals from the first circuit board to the second circuit board.

With this constitution, when a signal is outputted to the second housing side on the basis of manipulation of a button provided to the first housing, the number of signal lines routed from the first housing side to the second housing side can be reduced by signal processing by the first circuit board, so the connecting member disposed in the second housing can be made correspondingly smaller, or more signals can be transmitted from the first housing side to the second housing side with the same connecting member. Therefore, even if there are many signals, a correspondingly compact manipulation apparatus, and a movement apparatus comprising this manipulation apparatus, can be provided. If the manipulation apparatus needs to have higher functionality, the number of signals often tends to increase, in which case this advantage is particularly beneficial.

The first housing may be provided with an emergency stop switch for directing an emergency stop.

With this constitution, if the operator becomes aware of some kind of danger while manipulating the manipulation apparatus, the apparatus can be quickly shut down to ensure safety. Also, even if the number of signals to be outputted to the second housing side increases as a result of an emergency stop switch being provided to the first housing, the number of signal lines routed from the first housing side to the second housing side can be reduced by signal processing by the first circuit board, a safe manipulation apparatus can be designed without too much difficulty.

In yet another preferred embodiment of the movement apparatus pertaining to the present invention, a reporting component for reporting the direction of operation of the drive device directed by the operator is provided to the face of the first housing and/or the second housing which is located on the opposite side from the side of the operator when the operator holds the first housing.

With this constitution, since the operator himself is notified again of the direction in which the trolley is facing when the operator is manipulating the apparatus, he can safely and assuredly perform the manipulation while checking the report content, and can pay attention to the trolley, to a movement direction that the object is being moved by the trolley, and to people in the surrounding area (people around the operator), so accidents can be prevented. Also, the people in the surrounding area can find out the direction in which the trolley is facing, that is, the direction in which the moving object is facing, even though they have not checked the display on the display component, and can be quickly made aware of danger to themselves by proximity to the trolley or object.

The reporting component may be a lighting device for lighting the direction of operation of the drive device directed by the operator.

With this constitution, since the light emitted from the manipulation apparatus illuminates the movement direction of the trolley, or of the object by the trolley, directed by the operator with the manipulation apparatus, the operator and people around the operator can visually and intuitively recognize this movement direction.

In yet another preferred embodiment of the movement apparatus pertaining to the present invention, there are provided production means that is provided at a place apart from and not in contact with the manipulation apparatus and that produces a reference signal that is matched to a specific position and/or direction of the manipulation apparatus, and a reference position adjuster that receives a reference signal produced by the production means and performs adjustment of a reference position and/or reference direction when the manipulation apparatus is in the specific position and/or direction.

If the manipulation apparatus is in a place that is away from and not in contact with the controller side of the drive device that receives directives from the manipulation apparatus, the manipulation apparatus detects its own position independently by using a gyroscope or other such position detecting means, and outputs a movement directive to the controller on the basis of information related to the detected position, either wirelessly or over a wire. However, if the operator manipulates the manipulation apparatus while carrying it, error accumulates in the information related to the position of the manipulation apparatus detected by the position detecting means, which may lead to an inaccurate movement directive by the controller. With the above constitution, however, a reference signal that is matched to a specific position and/or direction of the manipulation apparatus is received from outside, and the reference position and/or reference direction of the manipulation apparatus is adjusted on the basis of the reference signal, so even if error accumulates in the information related to the position of the manipulation apparatus, that error can be eliminated periodically or non-periodically, allowing the accuracy of the movement directive from the controller to be maintained.

In yet another preferred embodiment of the movement apparatus pertaining to the present invention, the manipulation apparatus is provided with a plurality of production means that are disposed a specific distance apart from each other and each produce a reference signal, and there is provided a reference position constituting component that has three or more signal receivers each detecting the reference signal and disposed apart from each other and at places that are apart from and not in contact with the manipulation apparatus, and a computer for computing the position and/or direction of the manipulation apparatus on the basis of detection signals from the signal receivers.

With this constitution, a plurality of reference signals are emitted from the outer surface of the manipulation apparatus, and the position and/or direction of the manipulation apparatus is found and subjected to reference position adjustment by the computer on the basis of a reference signal and the detected signals detected by the three or more mutually separated signal receivers and signal receivers at positions that are apart from each other and not in contact with the manipulation apparatus, so no error occurs in the movement directive information, so it is possible to prevent the above-mentioned problem, namely, that error accumulates in the information related to the position of the manipulation apparatus detected by a gyroscope or other such position detecting means when the operator carries around the manipulation apparatus and operates it, which causes the movement directive from the controller to be inaccurate.

The movement apparatus pertaining to the present invention is further a manipulation apparatus capable of manipulating an operation direction of a drive device utilized in the movement of an object by changing a turning amount or turning direction of relative turning between a first housing and a second housing, wherein the first housing and the second housing are linked by a tubular member in which a signal cable is inserted, along a perpendicular turning axis, the second housing is provided to a trolley disposed above as part of the drive device, the first housing is able to turn relative to the second housing, and the first housing is provided with an indicator for indicating, in a mode that is visible by an operator, information related to the turning amount or turning direction of the relative turning, around a turning axis of the relative turning.

With this movement apparatus, the second housing is disposed above and apart from the first housing, and only the first housing is held and manipulated by the operator, so the manipulation apparatus manipulated by the operator substantially corresponds to the first housing. Consequently, the manipulation apparatus substantially manipulated by the operator can be formed in a compact size, and can be light in weight and easy to handle. Also, since the second housing does not enter, or tends not to enter, the field of vision of the operator holding the first housing, this combines with the reduction in weight to make manipulation much easier. Furthermore, the second housing is disposed at a place where it tends not to be affected by vibration or impact imparted from the outside to the first housing, or above, where vibration and impact tend not to be imparted from the outside, so this manipulation apparatus is less likely to malfunction or suffer other problems, and can withstand extended use.

Also, with this movement apparatus, since an indicator that indicates, in a mode that is visible to the operator, information related to the degree of relative turning or the direction of turning is formed at the first housing and/or the second housing, the operator can see the information indicated by this indicator and thereby recognize the amount or direction of manipulation he himself has performed or, from another viewpoint, his own standing position, manipulation orientation, or manipulation behavior. This makes it easy for the operator to confirm or estimate, by means near at hand, the operation of a drive device used for the movement of an object, or the sense of distance or positional relation between himself, the object, and the drive device, or in some cases the sense of distance or positional relation between himself and other devices, apparatuses, or other such articles in his surrounding environment or people in his surroundings, and at the same time allows precise manipulation directives to be issued, so that the manipulation can be carried out more safely.

The above-mentioned constitution, namely, disposing the second housing above and apart from the first housing, is particularly beneficial when there are many parts in the second housing that are relatively susceptible to impact from the outside (such as a circuit board for signal processing, or an electronic device for detecting the relative turning). This is because the effect, in which vibration or impact imparted from the outside to the first housing tends not to affect the second housing, so malfunction or other trouble is less likely to occur, is more pronounced in such cases. The above constitution is also beneficial in terms of affording greater latitude in the design of the manipulation apparatus when means for improving the impact resistance of the manipulation apparatus is provided, since providing this means in the first housing is all that needs to be done.

As discussed above, the present invention provides a manipulation apparatus which is easy for the operator to handle, can be formed in a compact size, and can issue precise manipulation directives, and with which the movement direction of a crane or another such movement apparatus can be easily confirmed near at hand at the same time, as well as a movement apparatus comprising this manipulation apparatus.

EXPLANATION OF REFERENCE NUMERALS

Figure 1:
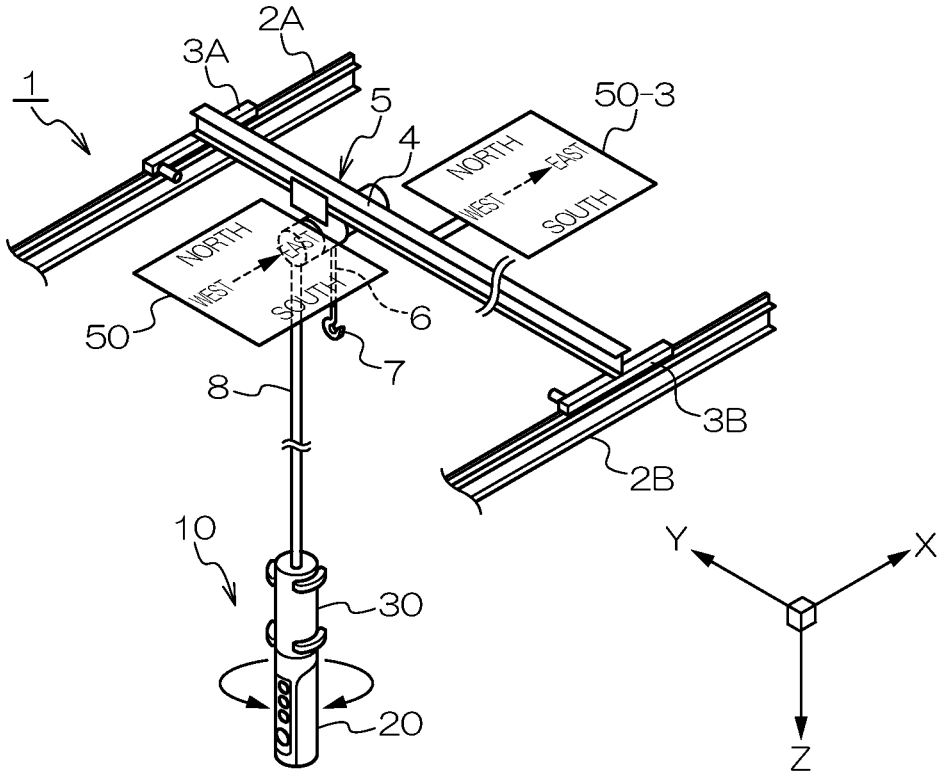
FIG. 1 is an oblique view of the overall configuration of an overhead crane serving as the movement apparatus pertaining to an embodiment of the present invention.

1, 1-1 . . . movement apparatus (overhead crane), 2A, 2B . . . X direction rail, 3A, 3B . . . saddle, 4 . . . crane girder (Y direction rail), 5 . . . trolley, 7 . . . hook, 8 . . . communication cable, 10, 10-1 . . . remote control (manipulation apparatus), 20 . . . first housing, 30 . . . second housing, 32 . . . slip ring, 35 . . . rotary encoder, 41 . . . indicator, 50 . . . display component

BEST MODE FOR CARRYING OUT THE INVENTION

The best mode for carrying out the invention will now be described in detail through reference to the appended drawings. This description will refer to the drawings as needed, and portions in the drawings that are the same or equivalent or shared will be numbered the same, and will not always be described more than once. Since the embodiments discussed below are preferred, specific examples of the present invention, various technologically favorable limitations are imposed, but the scope of the present invention is not limited to or by these modes unless it is specifically stated in the following description that the present invention is limited.

First Embodiment

Figure 2:
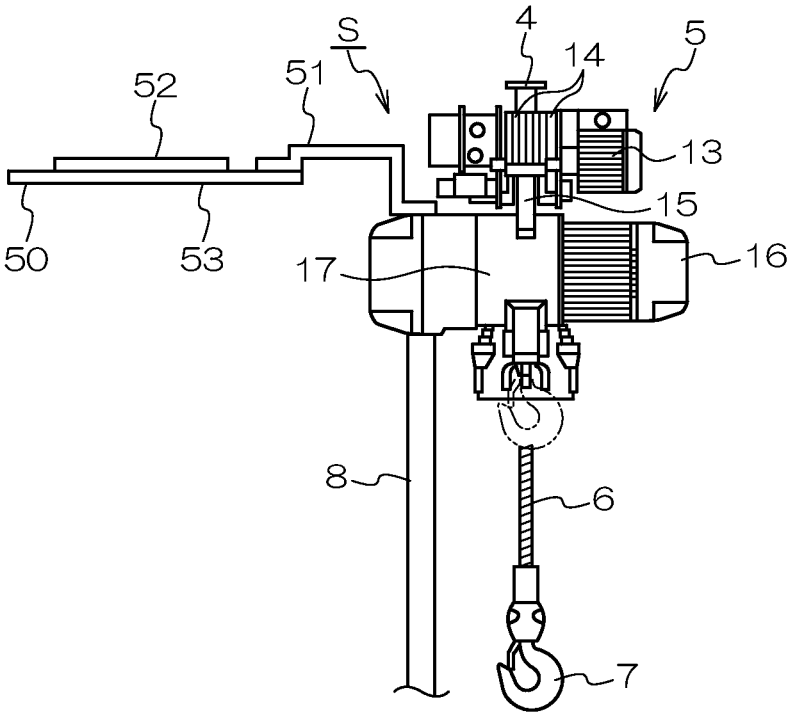
FIG. 2 is a diagram of the structure of a winch serving as the hoist of an overhead crane serving as the movement apparatus pertaining to an embodiment of the present invention.

FIG. 1 is an oblique view of the overall configuration of an overhead crane serving as the movement apparatus pertaining to an embodiment of the present invention. FIG. 2 is a diagram of the structure of a winch serving as the hoist of an overhead crane serving as the movement apparatus pertaining to an embodiment of the present invention.

As shown in FIG. 1, the overhead crane 1 serving as the movement apparatus pertaining to this embodiment has at least a pair of trolley rails 2A and 2B, which are X direction rails, disposed parallel to the X direction with a specific gap between them, near the ceiling of a building. A pair of saddle rails 3A and 3B that travel in the X direction are in contact by wheels with these X direction rails 2A and 2B, respectively. A crane girder 4, which is a Y direction rail disposed in the Y direction, perpendicular to the X direction, is provided between the saddle rails 3A and 3B. There is also a trolley 5 that moves in the Y direction along the crane girder 4 and is equipped with a winch that hoists cargo, etc., along the Z direction perpendicular to the X and Y directions.

Specifically, the trolley 5 is a travelling hoist, and is constituted such that a hook 7 is fixed as a moving body to the distal end of a support cable 6 that is wound up by the trolley 5.

Thus, since the overhead crane 1 is constituted such that the crane girder 4 spans substantially perpendicularly to the trolley rails 2A and 2B, and the trolley 5 having the hook 7 at its distal end travels over this crane girder 4, this is suitable as the movement apparatus pertaining to the present invention, which focuses on a three-dimensional movement mechanism equipped with a Z axis motor that moves the hook 7 serving as a moving body up and down, and an X axis motor and a Y axis motor that move the hook 7 in the horizontal plane.

A communication cable 8 that serves as a slender member and that bends but does not twist hangs down from the trolley 5, close to the floor. The lower end of the communication cable 8 is connected to a remote control 10, which is a manipulation apparatus having a second housing 30 that does not turn and be displaced relative to the communication cable 8, and a first housing 20 that is able to turn with respect to the second housing.

The communication cable 8 here that bends but does not twist is electrically connected to the remote control 10 and has communication wires built into a cable tube that bends but does not twist. More specifically, the "cable tube that bends but does not twist" can be a flexible metal conduit or flexible resin-covered metal conduit as set forth in JIS C 8309. A Plica Tube or Waterproof Plica Tube (trade names) made by Sankei Seisakusho can be used, for example.

As shown in FIG. 2, the trolley 5 has a pair of wheels 14 provided flanking the crane girder 4, and these wheels 14 are driven and turned by a lateral movement motor (Y axis motor) 13, which causes the trolley 5 to move laterally along the crane girder 4. A winch main body 17 is supported by a support member 15 and hangs down from the lateral movement unit. A winding motor (Z axis motor) 16 for winding up or playing out the support cable 6 is attached to the winch main body 17.

A travel motor (X axis motor) and travel wheels (not shown) are provided to each of the saddle rails 3A and 3B that travel over the trolley rails 2A and 2B and support at both ends the crane girder 4 shown in FIG. 1. A motor drive control circuit for driving the X axis motor, a Y axis motor 27, and a Z axis motor 29 according to the manipulation of the remote control 10 is built into the winch main body 17 shown in FIG. 2.

In this embodiment, a display component that displays the direction of advance of the object or the turning direction of the second housing 30 with respect to the first housing 20 is provided at a place within the field of vision of the operator but in a region of the remote control 10 other than the surfaces of the first housing 20 and the second housing 30. At least part of the display by the display component changes in synchronization with changes in the indication by the indicator of the first housing (discussed below).

In FIGS. 1 and 2, a display component 50 is constituted as a direction display device, and allows people present within a wide range to visually recognize the direction in which the trolley 5 is facing when it is travelling under directive of the remote control 10, by means of letters or symbols that are as large as possible. The method of the display component 50 for reporting the direction can be suitably selected, but examples include displays of light, sound, or different colors, lettering, and so forth.

The place where the display component 50 is installed is preferably the ceiling or another high place that can be seen from over a wide range. For instance, when the display component 50 is used for an overhead crane, it may be installed at a suitable place on the crane girder 4 where it will not collide with the trolley 5. If the display component is installed on the crane girder 4, it is preferably installed on the crane girder 4 near the center in the length direction of the crane girder 4 (limited to suitable locations where it will not collide with the trolley 5). Since the crane girder 4 is the movement path of the trolley 5, if the display component 50 is installed on the crane girder 4, it will be easy for an operator monitoring the movement of the trolley 5, and people around the operator, to see the display component 50, and even if the display component 50 should momentarily leave the field of vision and be out of sight, its location can be quickly ascertained.

In this embodiment, as can be seen in FIG. 2, a stay 51 is fixed to the upper face of the winch main body 17 serving as the trolley 5, and the display component 50 is attached to this stay 51 so that its display face 53 is facing down. 52 in the drawing is a drive circuit for the display component 50.

When the display component 50 is used for an overhead crane installed in a large facility, it is preferably installed on the trolley 5, that is, on the crane girder 4, and preferably fixed near the center in the length direction of the crane girder 4. This is because tracking the display component 50 by eye as it moves along with the trolley 5 which moves within a large facility is dangerous, and it is actually less dangerous to fix the display component 50 in a specific position.

Rather than using just one display component 50, a plurality of them may be provided. For example, another display component 50*a* may be provided, and it may be disposed in a control room (not shown) at some place away from the overhead crane. This allows facility managers to be aware of the current movement of the crane, which is convenient for management.

Also, a plurality of display components 50 can be installed not just in a control room, but also on the ceiling of a factory, columns in the factory, the walls of the factory, or any other place other than the outer face of the remote control 10. That is, they can be installed at any place that can be seen by people around the operator.

Furthermore, the display on the display component need not be just shapes or colors, and instead of these, or in addition to these, a guide component 34 that announces the travel direction of the trolley 5 of the crane with a voice may be provided so that the operator or people around the operator can be made aware of this information audibly.

Detailed configuration examples of the display component 50 will be discussed below.

Next, the structure of the remote control 10 pertaining to this embodiment will be described through reference FIGS. 3 and 4.

As shown in these drawings, the remote control 10 is designed so that the operation direction of a drive device utilized in the movement of an object (cargo or the like) can be manipulated by changing the turning amount of relative turning between the first housing 20 and the second housing 30. The second housing 30 is fixed on the drive device side via the communication cable 8. The first housing 20 and the second housing 30 are connected in a state of mutual contact so as to be capable of relative turning. In this embodiment the first housing 20 and the second housing 30 are integrally connected and are connected opposite each other, each in a cylindrical shape, by bearings or the like (discussed below). An indicator 41 that indicates, in a mode that is visible to an operator, information related to the degree of relative turning (turning amount) or the turning direction is provided to the surface of the first housing 20 and the second housing 30 around the turning axis of the relative turning, near the positions where these housings are in contact.

In this embodiment, the indicator 41 is formed including at least graduations composed of short, vertical lines disposed at regular intervals in a narrow band-shaped region that goes around an extension of the region where the second housing 30, which is integrated with the communication cable 8 and does not undergo turning displacement in the horizontal direction, is in contact with the first housing 20. The indicator 41 in this embodiment is formed by graduations and letters, but the letters are not necessarily required, and geometric markings or the like that encode the directions of north, south, east, and west, for example, may be written. In this embodiment, the letters corresponding to the positions for north, south, east, and west are written in kanji, but these kanji may be replaced with the upper-case English letters (EWSN), or English letters may be used in addition to the kanji.

When the operator holds the first housing 20 and presses a travel button 22 (discussed below) in a state in which the character for "south" is facing him, the trolley 5 moves in the direction of "north."

On the other hand, if it is felt that movement in the actual direction meant by the letters or symbols that the operator sees is convenient in terms of manipulation impression, or is safer, the system can be set up so that the trolley 5 moves in the direction of "south" when the travel button 22 (discussed below) is pressed in a state in which the character for "south" is facing the operator.

Figure 3:
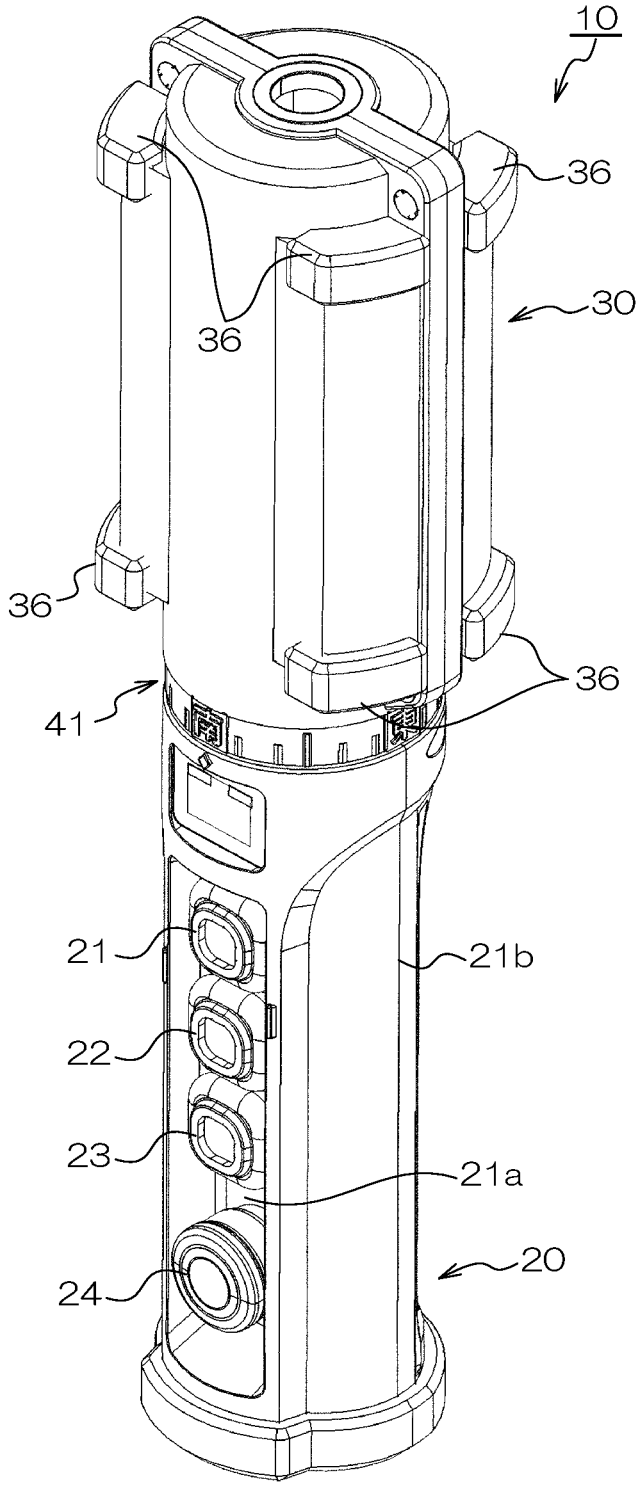
FIG. 3 is a simplified oblique view of the manipulation apparatus pertaining to an embodiment of the present invention.
Figure 4:
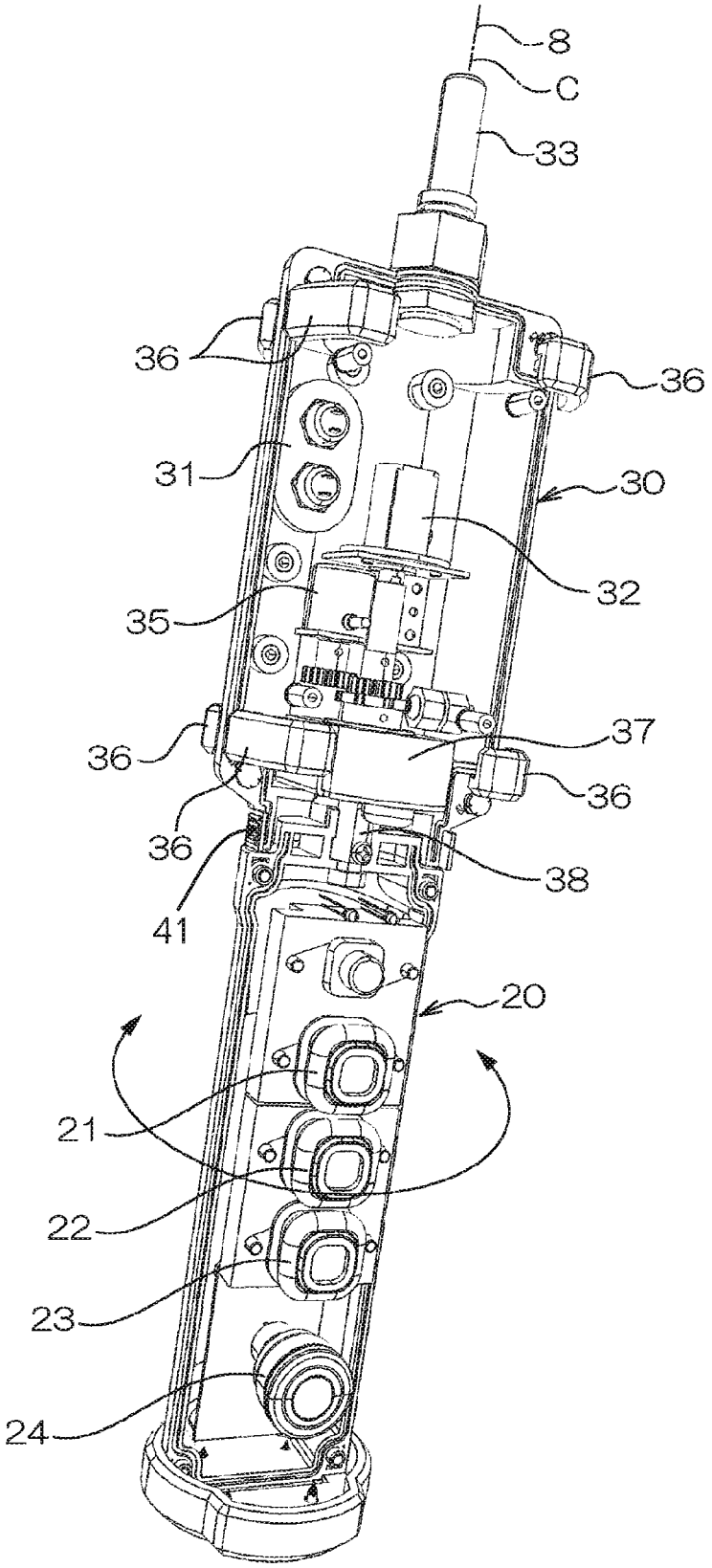
FIG. 4 is a vertical cross section of the manipulation apparatus pertaining to an embodiment of the present invention.

In FIGS. 3 and 4, in this embodiment, the first housing 20 and the second housing 30 of the remote control 10 are both cylindrical in shape, and are designed to be able to accommodate the necessary parts (discussed below) in their hollow interior. The shape of the housings is not limited to being cylindrical as discussed below, and one or both can be conical or have some other suitable form.

The first housing 20 is in the form of a cylinder that is narrower than the second housing 30, so that it is easier for the operator to grasp and hold. The second housing 30 has a cylindrical shape that is somewhat thicker than the first housing, and the parts that it holds are sized accordingly.

Impact reduction members 36 in the form of wide bumps that stick out in the form of short flanges or ribs are provided around the outer periphery at both ends of the second housing 30. The impact reduction members 36 are formed, for example, from an elastic resin or the like by two-color molding with the second housing 30. Accordingly, if the remote control 10 should be about to come into contact or collide with something on the outside, these impact reduction members 36 will avoid contact or collision, or can reduce the impact caused by contact or collision. Consequently, this protects not only the internal structure of the housing of the remote control 10 (and particularly electronic parts that are susceptible to impact or vibration), but also its appearance.

In FIG. 4, the second housing 30 is substantially immobile in relation to the turning direction of the communication cable 8 via a shaft 33 and the communication cable 8 serving as a cable tube. The first housing 20 is connected by a bearing 37 so as to be able to turn as indicated by the arrow with respect to the second housing 30. Furthermore, a tubular component (discussed below) passes through the center in the radial direction of the second housing 30 and the first housing 20.

The inside of the second housing 30 also has, for example, a rotary encoder 35 serving as a turning detector, and a slip ring 32 serving as a connecting member for relaying signals from the first housing 20 and transmitting them to the drive control device side of the travelling device.

Specifically, the turning detector detects relative turning displacement of the first housing 20 with respect to the second housing 30, and as long as it exhibits this function, some other means besides a rotary encoder may be used. The connecting member may be some other means besides the slip ring 32, as long as it can transmit signals from the first housing 20, which undergoes relative turning displacement, to the drive control device side in a contact state, inside the second housing 30.

Inside the first housing 20 are formed push buttons (switches) 21, 22, 23, and 24 that correspond to contacts formed in the circuit of a circuit board (not shown). 21 is a manipulation button for emitting a directive for moving the trolley 5 (see FIG. 1).

Specifically, these manipulation buttons, for example, emit directives to the trolley 5, operate the hoist, and comprise a up button 21 for lifting an object (cargo or the like), a travel button 22, and a down button 23. In addition to these buttons, an emergency stop switch 24 is provided to the apparatus.

These buttons are disposed, for example, arranged in a row in the vertical direction on one side face of the first housing 20. In particular, in this embodiment, a long recess is formed in the vertical direction on one side face of the first housing 20, and the buttons are housed in this recess 21*a*, so that they do not stick out far, or are not exposed, from the outer face of the first housing 20. Accordingly, this prevents accidental manipulation caused by any of the buttons being unexpectedly pushed down by contact. The emergency stop switch 24 is formed to be larger than the other buttons and at the lowest level, which makes it easier to recognize and use in the event of an emergency. Also, at least the part of the first housing 20 where the above-mentioned buttons are formed is covered with a waterproof sheet, vinyl, or the like to create a waterproof and dustproof structure.

A constricted portion where the overall thickness diameter is reduced is provided at the outer face 21*b* on the opposite side of the first housing from where the buttons are disposed, which makes it easier to grip and hold the first housing.

Also, an optical rotary encoder 35 functioning as a turning detector serving as means for determining the direction of the first housing 20 is provided on the inside of the remote control 10, and measures how many degrees the remote control 10 has turned, and to which side, with respect to a reference direction (in this embodiment, for example, a direction in which the remote control 10 faces three-dimensionally perpendicular to the crane girder 4, as shown in FIG. 1). This turning angle data is transmitted as an electrical signal through the communication wires contained in the communication cable 8, to the motor drive control circuit built into the winch main body 17.

When the travel button 22 is lightly pressed, an electrical signal indicating that the travel button 22 has been lightly pressed is transmitted via the slip ring 32 serving as the connecting member, for example, and through the communication wires contained in the communication cable 8 to the motor drive control circuit built into the winch main body 17, the X axis motor and/or the Y axis motor 27 is actuated by control of the motor drive control circuit, and the hook 7 serving as the moving body moves horizontally in the direction of the remote control 10, or more specifically, the direction that is exactly opposite the front of the remote control 10.

This control in the motor drive control circuit will be described through reference to FIG. 5.

Figure 5:
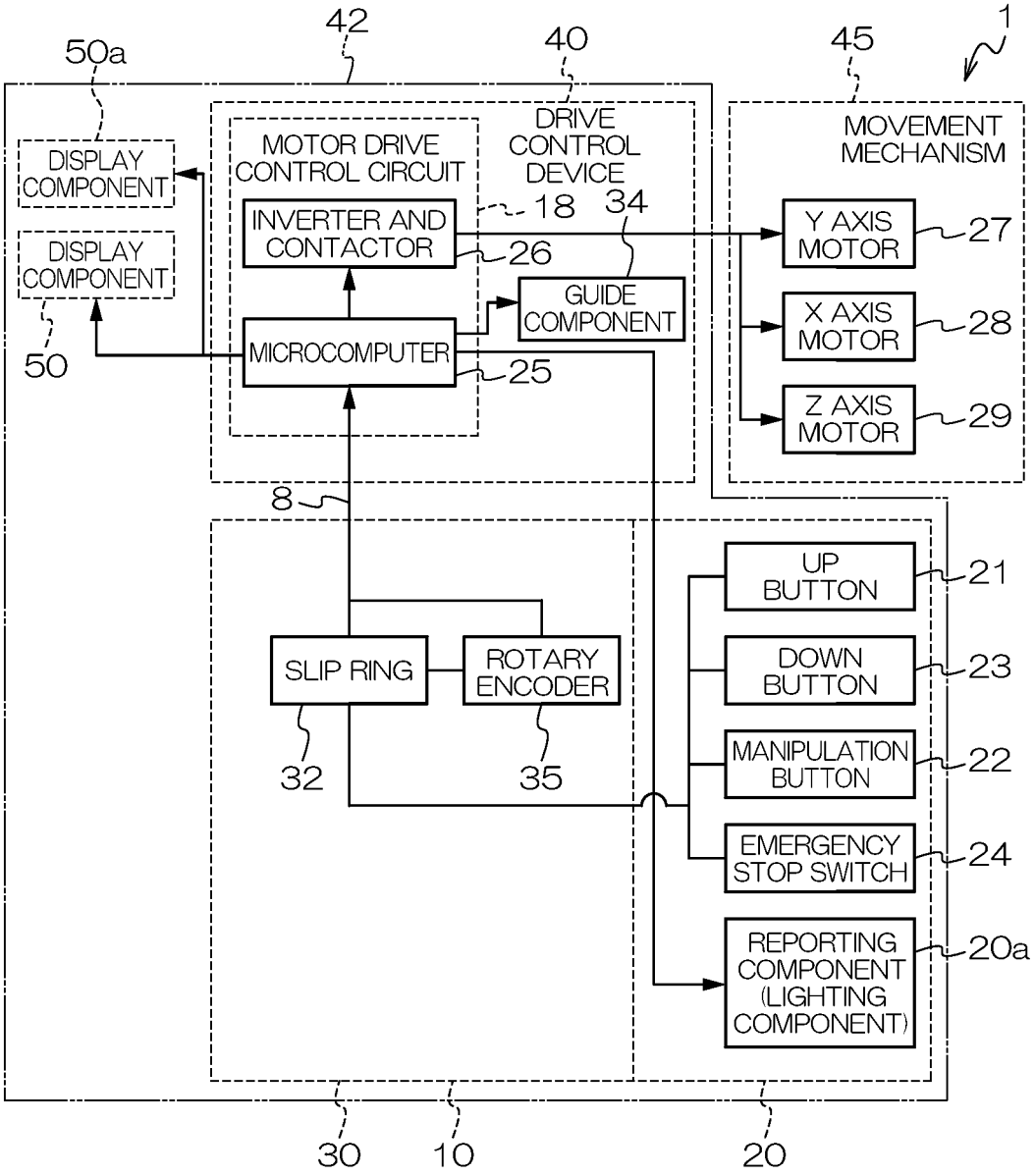
FIG. 5 is a graph of an electrical configuration example of an overhead crane serving as the movement apparatus pertaining to an embodiment of the present invention.

In FIGS. 3 to 5, the first housing 20 of the remote control 10 is provided with the travel button 22, the up button 21, the down button 23, and the emergency stop switch 24, and the circuit board (not shown) required for these and so forth are housed therein. Also, the first housing 20 preferably houses a reporting component (discussed below) or a work assistance component, and in this embodiment, it is a lighting component 20*a*, for example. The buttons and the lighting component are connected with a drive device 18 for example a motor drive control circuit, which is built into the winch main body 17, or a microcomputer 25 thereof, through the communication wires contained in the communication cable 8.

In FIG. 5, 18 is a motor control circuit, 42 is a movement control device that includes a motor control circuit, the remote control 10, the display component 50 (discussed below), the communication cable 8, and so forth, and 45 is a movement mechanism.

A rotary encoder (optical rotary encoder) (discussed below) is built into the second housing 30 of the remote control 10 as a turning detector, which serves as means for determining the direction of the first housing 20 according to manipulation by an operator (described in detail below). Also, the slip ring 32, for example, is housed as a connector for transmitting electrical signals and maintaining a connection, and these are connected to a motor drive control circuit built into the winch main body 17, or a microcomputer 25 thereof, through the communication wires contained in the communication cable 8.

The motor drive control circuit 18 built into the winch main body 17 also comprises the microcomputer 25, and an inverter and contactor 26.

The microcomputer 25 here is equipped with a CPU (central processing unit), a memory device such as a RAM or ROM, and an input/output (I/O) device, receives electrical signals sent from the remote control 10 through the communication wires in the communication cable 8, performs necessary computation processing, and outputs the processing results as electrical signals to the inverter and contactor 26. The microcomputer 25 may be what is known as a one-chip microcomputer, or it may be constituted by a plurality of chips or elements and parts.

The microcomputer 20 is connected with the drive circuit of the display component 50 illustrated in FIGS. 1 and 2, and displays the travel direction of the trolley 5 on the basis of the manipulation result of the remote control 10 (discussed below).

In FIG. 4, the optical rotary encoder 35 measures how many degrees the first housing 20 of the remote control 10 has turned, and to which side from a home position with respect to the communication cable 8, and transmits the measured value as an electrical signal through the communication wires in the communication cable 8 to the microcomputer 25. If the travel button 22 has been pressed, a specific electrical signal is sent through the communication wires in the communication cable 8 to the microcomputer 25, the microcomputer 25 sends a control signal to the inverter and contactor 26, the inverter and contactor 26 supply drive current to the X axis motor 28 and/or the Y axis motor 27 according to this control signal, and this drives the X axis motor 28 and/or the Y axis motor 27 and moves the trolley 5, with the result being that the hook 7 attached to the trolley 5 is moved in the direction in which the remote control 10 is facing.

The "inverter and contactor" 26 here may comprise just an inverter, but preferably comprises both an inverter and a contactor, and preferably the microcomputer 25 emits a directive and selects which one to use according to the characteristics of what is being driven.

The motor drive control circuit 18 that includes the inverter 26 and the microcomputer 25 controls the drive of the X axis motor 28, the Y axis motor 27, and the Z axis motor 29.

Thus, the drive control device 40 of the movement apparatus 1 is constituted by providing a motor drive control circuit. The movement mechanism 45 is constituted by providing the X axis motor 28, the Y axis motor 27, and the Z axis motor 29, and these are manipulated by the operator through the remote control 10.

Here, when the inverter 26 is used, the amount of drive current supplied to the X axis motor 28 and the Y axis motor 27 can be controlled continuously variably, so the trolley 5 an be moved linearly in the direction in which the remote control housing 10 is facing, but if the contactor 26 is used in place of the inverter, the amount of drive current supplied to the X axis motor 28 and the Y axis motor 27 will always remain the same, so the hook 7 of the trolley 5 can only be moved in a total of eight directions: directions parallel to the trolley rails 2A and 2B, a direction parallel to the crane girder 4, and intermediate directions of these. Therefore, the hook 7 of the trolley 5 moves in the direction in which the remote control 10 housing is facing by travelling in a zigzag motion when looked at closely.

When the up button 21 and the down button 23 serving as up and down switches provided to the remote control 10 are pressed, a specific electrical signal is transmitted through the communication wires in the communication cable 8 to the contactor 26 built into the winch main body 17, just as with the motor drive control circuit 18, and drive current is supplied from the contactor 26 to the Z axis motor 29. When the up button 21 is pressed, the Z axis motor 29 operates so as to wind up the support cable 6 and lift the hook 7, and when the up switch 23 is pressed, the Z axis motor 29 plays out the support cable 6 so that the hook 7 is lowered.

Figure 6:
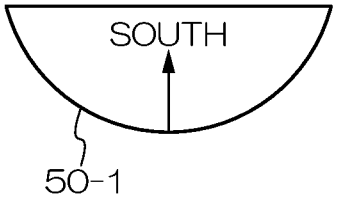
FIG. 6 is a simplified front view of a configuration example of the display component provided to the movement apparatus pertaining to an embodiment of the present invention.
Figure 7:
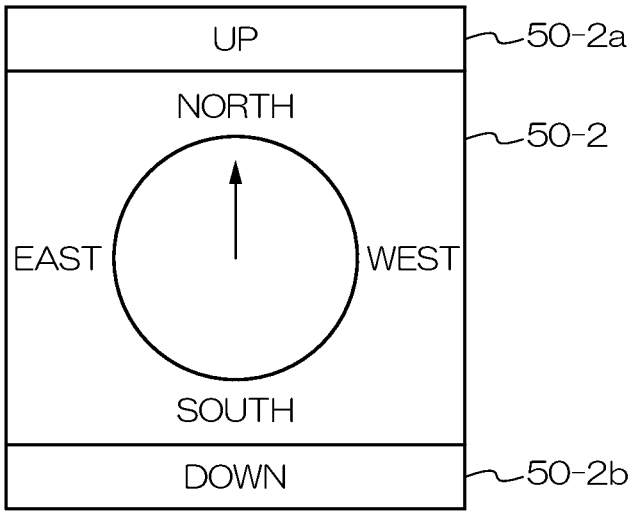
FIG. 7 is a simplified front view of a configuration example of the display component provided to the movement apparatus pertaining to an embodiment of the present invention.

FIGS. 6 and 7 illustrate the display component 50 illustrated in FIGS. 1 and 2.

The display component 50 is not limited to any specific technological means, so long as it is able to display directions relatively large, but favorable examples include liquid crystal display devices, display devices that make use of LEDs (light emitting diodes) to indicate a direction optically by means of an arrow display or the like, EL, photocells, and other such devices that utilize segments, and various other devices.

More specifically, as shown by the display component 50-1 in FIG. 6, the display component 50-2 in FIG. 7, etc., a display method is employed in which there is a combination of a directional display by an arrow and a display portion consisting of letters, as in 50-1*a*, 50-1*b*, 50-2*a*, and 50-2*b* (in this case, "UP" and "DOWN" in English).

For example, when a signal from the remote control 10 is inputted via the microcomputer 25, the display component 50-2 in FIG. 7, for example, displays by changing the display color (such as blue) of the stage at which the direction was selected, and the display color (such as red) when the movement of the trolley 5 (including the drive of the winch) is executed. Consequently, people in the area can be apprised of the actual movement timing, so that warnings can be issued in stages.

Also, when the remote control 10 issues a directive to move the trolley 5, for example, an arrow may be made to flash, and when the movement is actually carried out, the arrow may be changed to a steadily lit display.

What is particularly important is that at least part of the display by the display component 50, such as directional display excluding text display, changes in synchronization with a change in the indication by the indicator 41 of the first housing 20 illustrated in FIG. 3, at a directive from the microcomputer 25 as in FIG. 5.

Consequently, what the operator himself recognizes in his manipulation of the remote control 10 perfectly matches information about movement of the trolley 5 and so forth provided to the people around the operator who are referring to the display component 50, and workplace accidents and so forth caused by discrepancies in recognition between the operator and people around the operator can be effectively prevented.

In particular, when a crane is carrying a large cargo or other such object in a workplace, the field of vision of people around the operator may be blocked in lower locations of the workplace, so that these people may not be able to predict the movement direction of the cargo, and will be at risk.

However, as already described, the display component 50 is disposed at the highest location in the workplace, which means that both the operator and people around the operator have real-time access to information such as the movement direction of cargo, and danger can be effectively avoided.

Also, particularly in the case in FIG. 6, the display face of the display component is not flat, but rather is a dome-shaped, curved face that protrudes downward. This makes it possible for it to be seen over a wider area within the space in which the overhead crane is installed.

Further, as indicated by 50-3 in FIG. 1, the display component may be provided near the middle in the length direction of the Y direction rail 4.

This allows the display component 50-3 to be seen by the operator and people around the operator over the widest range of the workplace area, and enhances safety.

With this constitution, the operator manipulating the overhead crane 1 shown in FIG. 1 actuates the Z axis motor 29 by pressing the up switch 23 of the remote control 10 to lower the hook 7. The hook 7 is hooked onto a transport object placed on the floor, the up button 21 is pressed to actuate the Z axis motor 29, the support cable 6 is wounded up, and the transport object is lifted to a height where there is no impediment to movement in the horizontal direction. Then, the remote control 10 is faced in the direction in which the transport object is to be moved, and the travel button 22 is lightly pressed to fine-tune the orientation of the remote control housing 10 while watching the movement direction of the transport object as it moves suspended on the hook 7, which allows the transport object to be moved in parallel and in the desired direction.

When the operator stops pressing the travel button 22, the travel button 22 returns under spring force and the hook 7 of the trolley 5 comes to a stop. Once it has been confirmed that the transport object is moving in the desired direction, the travel button 22 is firmly pressed in, which holds the travel button 22 in its depressed state, after which electrical signals for the direction of the remote control housing 10 are no longer transmitted, and the direction in which the hook 7 of the trolley 5 moves will not change even if the orientation of the remote control housing 10 is changed.

Once the transport object suspended from the hook 7 of the trolley 5 has moved horizontally to the desired location, the travel button 22 is released (if it is still being lightly pressed) or is firmly pressed in again (if the travel button 22 is fixed) to return the travel button 22 and stop the hook 7 of the trolley 5, and the up switch 23 is pressed to actuate the Z axis motor 29 in the direction of lowering the hook 7, the support cable 6 is played out, and the transport object is lowered under its own weight to a specific location.

Thus, with the overhead crane 1 pertaining to this embodiment, the manipulation apparatus is mainly provided with the first housing 20, which is compact and houses only the above-mentioned manipulation controls and boards required for them, turning shafts or the like that follow the movement of the operator's hand, and so forth, and the second housing 30, which houses means for the above-mentioned transmission. The first housing and second housing are connected in a contact state that allows the first housing to turn, and a configuration is obtained that allows the manipulation portion to be compact and the required functions to be realized.

Because of this, the indicator 41, which indicates, in a mode that is visible by the operator, information related to the extent of the relative turning or the direction of turning, is formed at the second housing 30, whose position is not affected by manipulations performed by the operator. Consequently, with the overhead crane 1 or other such equipment, for example, the operator can at all times be made visually aware of the correct bearing of the movement of the trolley 5, etc. The operator looks at this indicator 41 while moving the first housing 20 side, and thereby is at all times easily able to recognize and be aware of the drive direction.

The above constitution allows the manipulation apparatus to be formed in a compact size that is easy for the operator to handle, and allows manipulation directives to be issued precisely, and at the same time allows people around the operator who are near the crane or other movement apparatus to easily recognize or predict the behavior of the movement apparatus, so their work can be carried out quickly, reliably, and safely.

Figure 8:
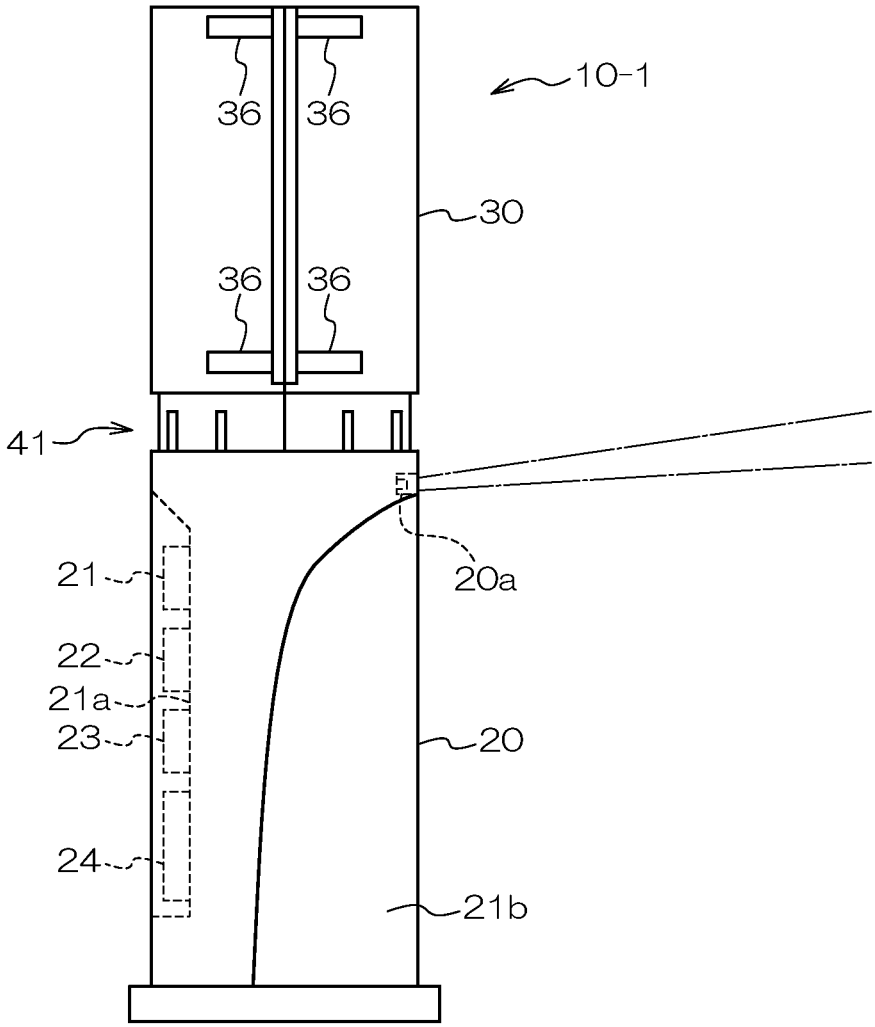
FIG. 8 is a simplified side view of the manipulation apparatus (first modification example) pertaining to an embodiment of the present invention.

FIG. 8 shows a favorable modification example of a remote control.

FIG. 8 is a simplified side view of a remote control 10-1, which is a first modification example. The first housing 20 in this drawing is equipped with a reporting component **20*a* for reporting the direction indicated by manipulation as the direction of operation of the trolley 5, at a face of the first housing 20 corresponding to the opposite side from the operator when the operator holds the first housing 20**.

In this embodiment, the reporting component **20*a* functions as work assistance means for the operator on the remote control 10. For example, it is a lighting device that forms a light spot and shines a directional light beam toward the direction in which the trolley 5** is travelling, as shown in the drawing.

This lighting device can be a relatively high-power LED, a red laser beam, illumination light from a bulb, a halogen lamp, a xenon lamp, or another such device that focuses a powerful light beam with a specific optical system.

Consequently, even if people around the operator do not check the display on the display component 50, they can still know the direction in which the trolley 5 is facing, that is, the direction in which the cargo, etc., is facing, from what the reporting component **20*a* tells them. Also, the operator himself will receive an updated report on the direction which the trolley 5** is facing while he is manipulating it, so he can check the report content while performing safe and secure manipulation.

Figure 9:
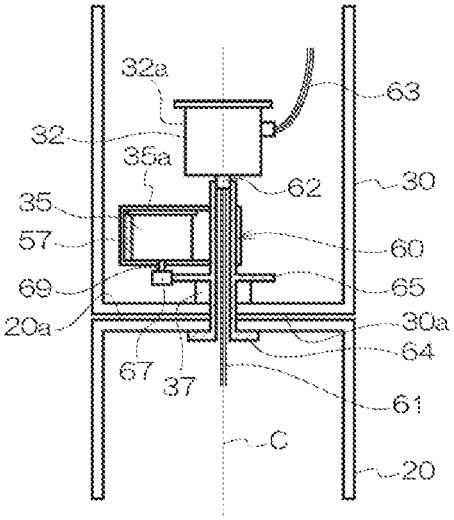
FIG. 9 is a partially enlarged cross section of a first internal configuration example of the housing portion of the manipulation apparatus (first modification example) pertaining to an embodiment of the present invention.
Figure 10:
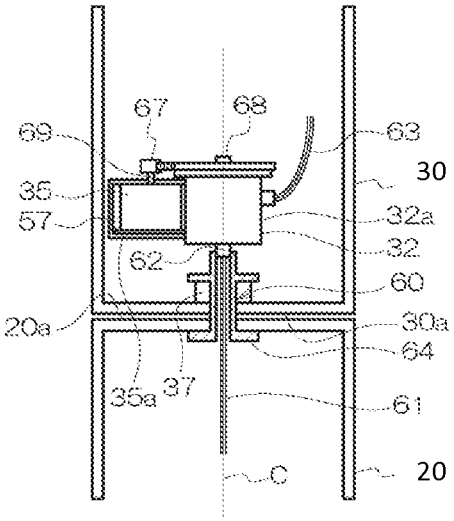
FIG. 10 is a partially enlarged cross section of a second internal configuration example of the housing portion of the manipulation apparatus (first modification example) pertaining to an embodiment of the present invention.
Figure 11:
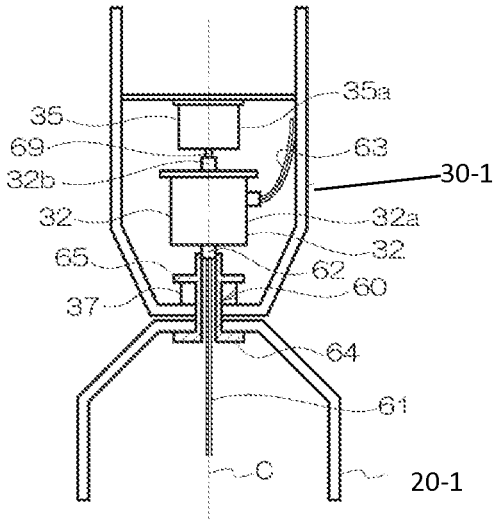
FIG. 11 is a partially enlarged cross section of a third internal configuration example of the housing portion of the manipulation apparatus (first modification example) pertaining to an embodiment of the present invention.
Figure 12:
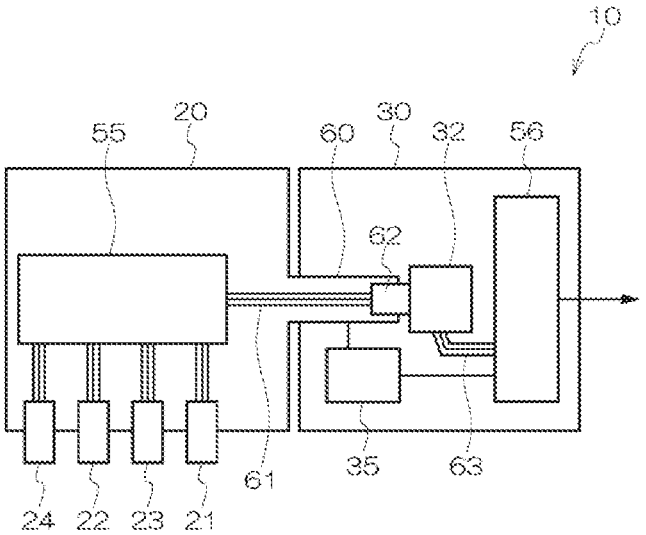
FIG. 12 is a block diagram of an electrical configuration example of the manipulation apparatus pertaining to an embodiment of the present invention.

FIGS. 9 to 11 show a number of favorable modes of the internal structure and modes of the first housing 20 and the second housing 30. FIG. 12 is a block diagram of the main electrical structures housed inside the first housing 20 and the second housing 30.

First, the electrical structure of the remote control 10 will be described.

In FIG. 12, those components that are numbered the same as in FIG. 5 share the same constitution, so redundant descriptions will be omitted.

The first housing 20 holds a first circuit board 55 connected to the various manipulation buttons (numbered 21, 22, 23, and 24). A matrix circuit corresponding to the manipulation buttons is formed on this first circuit board 55, and this circuit board is relayed so that signals are inputted to the slip ring 32 serving as a connecting member.

Signal lines from the first circuit board 55 go through a tubular component 60 that rotates along with a turning shaft 62 of the slip ring 32, and are thereby connected to the slip ring 32. The turning of the tubular component 60 is detected by the rotary encoder 35 serving as the turning detector. Signal lines 63 extending from the slip ring 32 are connected to the microcomputer 25 in FIG. 5 by the communication cable 8 via a second circuit board 56 for example a signal processing circuit (board).

In FIG. 9, the first housing 20 comprises, in its interior and near the distal end, the tubular component 60 that protrudes inward, passing through the lower end of the second housing 30, and the tubular component 60 is fixed to the first housing 20 by a fixing flange 64. The tubular component 60 passes through the approximate center in the radial direction of the first housing 20 and the second housing 30. The tubular component 60 is rotatably supported inside the second housing 30 by a bearing 30.

Preferably, the above-mentioned turning detector is an encoder, and in FIG. 9 the slip ring 32 comprises an outer sheath 32*a* disposed inside the second housing 30, and a rotary shaft 62 rotatably supported by this outer sheath 32*a*. The rotary shaft 62 is disposed concentrically with the imaginary center axis of the tubular component 60, which is the turning axis in the relative turning of the second housing 30 with respect to the first housing 20, and furthermore is constituted so that a signal corresponding to remote control manipulation from a signal line 61 is transmitted from the rotary shaft side to the outer sheath 32*a* side.

The encoder comprises a housing 35*a* and a rotor 69 rotatably (turnably) supported by the housing 35*a*. This rotor 69 is disposed in parallel and not coaxially with the major axis of the tubular component 60, and rotates by being linked by a rotation flange 65, pinion 67, etc., of the tubular component 60 with respect to the second housing 30.

Consequently, the rotor 69 of the encoder 35 is disposed in parallel and not coaxially with the major axis of the tubular component 60 that protrudes toward the inside of the second housing 30 as part of the first housing 20, and rotates by being linked to the relative turning of the tubular component 60 with respect to the second housing 30, so compared to when the rotor 69 of the encoder 35 is disposed coaxially with the major axis of the tubular component 60, an apparatus can be configured in which the length of the tubular component 60 in its major axis direction is shorter, and can therefore be more compact.

With this constitution, preferably a matrix circuit is employed on the circuit board 55 inside the first housing 20, as illustrated in FIG. 5.

Accordingly, there is a limit to the number of wires for signals transmitted by the slip ring 35 from the rotary shaft 69 side to the outer sheath 35*a*, so there is also a limit to the number of wires that can pass through the tubular component 60 that protrudes toward the inside of the second housing 30 as part of the first housing 20.

Therefore, when there are many buttons installed on the first housing 20, the number of wires increases correspondingly. Accordingly, the buttons installed on the first housing 20 cannot be connected through the tubular component 60 on the rotary shaft 69 side of the slip ring 35 installed inside the second housing 30.

In contrast, with the constitution discussed above, the number of wires for buttons (switches) is reduced by the matrix circuit installed inside the first housing 20, so even when there are many buttons, it is still possible to transmit signals corresponding to the manipulation of the buttons through the tubular component 60 to the rotary shaft side of the slip ring 35.

In FIG. 9, the first housing 20 and the second housing 30 are cylindrical in form, and at least the portions of these cylinders that are near each other have substantially the same diameter, with the indicator 41 illustrated in FIG. 3 formed at this portion where the diameter is the same. Furthermore, the opposing faces 20*a* and 30*a* of the first housing 20 and the second housing 30 are perpendicular to the imaginary turning axis C that passes through the center of the tubular component 60.

Therefore, if the outside diameter of the first housing and second housing is substantially the same as shown in the drawing, there will be no situation in which the indicator 41 falls in the shadow of the housing with the larger diameter and is therefore hard to see.

Let us refer to FIG. 10.

This mode is characterized by the fact that the rotary shaft of the slip ring 32 comprises a protrusion that protrudes on the second housing side of the outer sheath, and the rotor of the encoder rotates in conjunction with the rotation of the protrusion.

With the above constitution, the rotary shaft of the slip ring comprises a protrusion 68 that protrudes on the second housing 30 side of the outer sheath 32*a*, and the rotor 69 of the encoder 35 rotates in conjunction with the rotation of the protrusion 68.

With this constitution, as shown in FIG. 10, as long as the apparatus is designed so that the length in the rotational axis direction is shorter, the direction of the distal end of the rotor 69 of the encoder 35 (the direction of protrusion on the second housing 30 side) and the direction of the distal end of the rotary shaft 62 of the slip ring 32 (the direction of protrusion on the first housing 20 side) are disposed in the opposite orientation, so the housing 35*a* of the encoder 35 and the outer sheath 32*a* of the slip ring 32 can be closer together, which affords a more compact layout overall.

As has already been described, with the remote control 10, the first housing 20 is disposed closer to the operator who manipulates the movement of an object (cargo, etc.), and the second housing 30 is connected to one end of a slender component (the communication cable 8).

Accordingly, when the first housing 20 is disposed the side closer to the operator manipulating the movement of cargo or another such object, and the second housing 30 is connected to one end of a slender component, the first housing 20 is disposed further beyond the one end. With this layout, strong impacts or vibrations tend to be imparted from the outside by the first housing 20 disposed at the distal end, and there is the risk that these will adversely affect electronic parts. For instance, when the operator lets go of the first housing in this state, the second housing 30 connected to the communication cable 8, and the first housing 20 at the end of the second housing 30, will swing like a pendulum, and there is the danger that will hit something nearby, and the first housing 20 ends up taking the hardest blow because it is disposed farther out.

In contrast, with the above constitution, electronic parts that are susceptible to impact or vibration from the outside, such as the encoder 35 that detects relative turning of the second housing 30 with respect to the first housing 20, and at least part of the slip ring 32 that transmits signals corresponding to button manipulation from the first housing 20 side to the second housing 30 side, are installed inside the second housing 30, and are not installed inside the first housing 20 that is disposed more to the distal end side, so the adverse effect of external impact or the like on the electronic parts can be prevented or mitigated.

Furthermore, a protective member 57 for protecting the encoder 35 is installed between the inner wall of the second housing 30 and the encoder 35.

Consequently, even though the encoder is installed near the inner wall of the second housing, it is protected by the protective member, so the encoder 35 can be installed inside the second housing 30 without its function being impaired. This is particularly beneficial when there is the risk of the electronic parts being adversely affected by impact or vibration from outside the housing, as this adverse effect can be prevented or mitigated.

In FIG. 11, the second housing 30 comprises a bearing member 32*b* that rotatably supports the tubular component 60 so that the major axis of the tubular component 60 is coaxial with the rotary shaft 62 of the slip ring 35. The tubular component 60 comprises a wiring through-path that extends between the inside of the first housing 20 and the inside of the second housing 30, and the relative turning of the second housing 30 with respect to the first housing 20 can be transmitted to the rotary shaft 62 of the slip ring 32.

Consequently, detecting with the encoder 35 the relative turning, with respect to the second housing 30, of the tubular component 60 that protrudes toward the inside of the second housing 30 as part of the first housing 20, is substantially the same as detecting the relative turning of the second housing 30 with respect to the first housing 20 by the encoder 35.

Therefore, with this constitution, it is possible to detect the relative turning of the second housing 30 with respect to the first housing 20 by means of the combination of the encoder 35 with the tubular component 60 that protrudes toward the inside of the second housing 30 as part of the first housing 20, or in other words, by means of the electronic parts installed inside the second housing 30. This affords a simpler internal structure and a more compact size.

Further, in the example in FIG. 11, the slip ring 32 and the encoder 35 are disposed vertically along the rotational axis, so the outside diameter of the second housing 30 can be reduced correspondingly, and a more compact size can be attained. Also, the contact area between the housings can be further reduced, so that rather than having two cylindrical shapes in contact, two cones or truncated cones are in contact, which also reduces sliding resistance during turning.

When the buttons installed in the first housing 20 are multistage switches or have a dustproof or waterproof structure, the space accounted for by these switches is greater than that with ordinary switches, and it is difficult to install them within the confined space inside the first housing 20. In contrast, if parts that are not directly related to button manipulation by the operator, such as the turning detector or connecting member, are installed in the second housing 30, then extra space can be ensured in the first housing 20, so even larger switches that take up more space can be installed in the first housing 20. This makes it possible to configure a manipulation apparatus that is highly dustproof or waterproof or with which highly functional button manipulation is possible.

Also, if parts directly related to button manipulation by the operator (such as the buttons 21, 22, 23 and 24, and the circuit board 55 on which a matrix circuit is formed) are installed in the first housing 20 and the second housing 30, and other parts (such as the slip ring 32 and the encoder 35) are installed in the second housing, then a good weight balance can be created, in which the weight distribution between the two housings is favorable, and this in turn results in a manipulation apparatus 10 that is more convenient for the operator to use.

Second Embodiment

Next, an overhead crane will be described as a movement apparatus pertaining to a second embodiment of the present invention.

The overhead crane pertaining to this second embodiment has substantially the same mechanical structure as that in FIGS. 1 and 2, and its electrical structure will be described through reference to FIG. 13.

Figure 13:
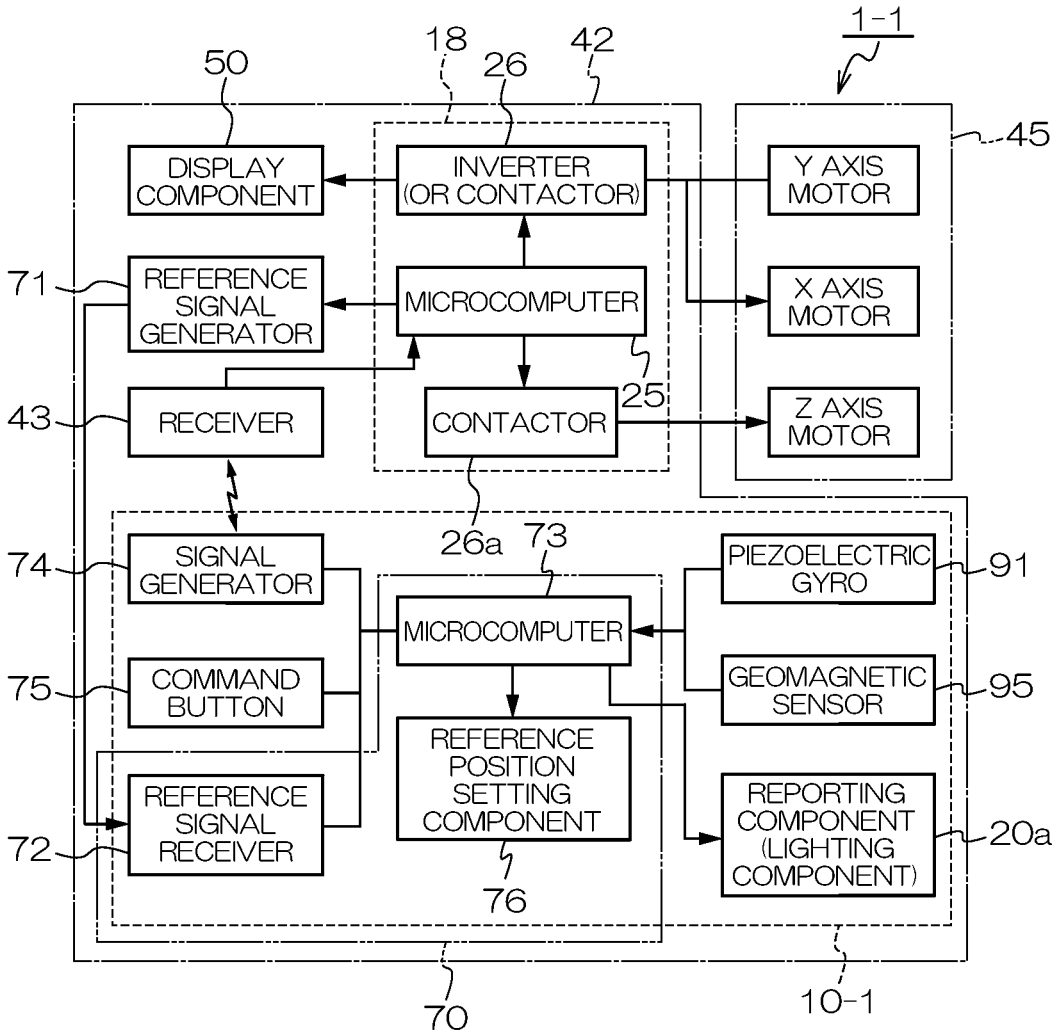
FIG. 13 is a block diagram of an electrical configuration example when a manipulation apparatus that manipulates an overhead crane wirelessly is used as the movement apparatus pertaining to another embodiment of the present invention.

FIG. 13 corresponds to FIG. 5, which illustrates the first embodiment, and in FIG. 13, 18 is a motor control circuit, 42 is a movement control apparatus that includes a motor control circuit and the remote control 10, the display component 50 (discussed below), the communication cable 8, and so forth, and 45 is a movement mechanism. In FIG. 13, those components that are numbered the same as in FIG. 5 share the same constitution, and redundant descriptions will be omitted below, focusing mainly on the differences.

In the second embodiment, the manipulation apparatus 10-1 is formed as a single housing, and therefore differs from the manipulation apparatus 10 of the first embodiment in which the housings turned relative to each other and thereby controlled the travel direction. In this embodiment, the position and movement of the manipulation apparatus 10-1 itself held by the operator are sent from an oscillation apparatus 74 and received by a receiver 43 on the drive control device side, so that manipulation is done wirelessly.

Infrared optical communication or any of various other remote communication means can be utilized besides wireless radio of various bands.

It is preferable to utilize a short distance wireless communication technology such as Bluetooth, with which the remote control 10-1 is carried into a room in which an overhead crane is installed, and when it approaches the receiver 43, this short distance wireless communication is actuated, allowing manipulation with the manipulation apparatus 10-1 after an exchange of protocols.

Consequently, if a dedicated protocol is used to execute manipulation with the remote control 10-1, accidental operation due to wireless noise or the like can be effectively prevented.

The above-mentioned Bluetooth or other such short distance wireless communication here is incorporated into the receiver 43 and the oscillation apparatus 74.

Alternatively, a button for adjusting the reference position, that is, for commencing calibration, may be provided to the command buttons 75, so that rather than automatically setting the reference position as above, reference position setting is performed by manipulating the button for setting the reference position when the operator starts using the equipment.

As shown in FIG. 13, a radio signal generator 74 is built into the remote control 10-1, the radio receiver 43 is built into the hoist, and the manipulation button 75 on the remote control 10-1 is manipulated so that the data is converted into a wireless signal and emitted as a radio wave from the signal generator 74. The receiver 43 receives this radio wave and converts it into an electrical signal, which is inputted to the input/output (I/O) port of the microcomputer 25 in the motor drive control circuit 18, and movement control is performed on the hook 7 and the trolley 5 serving as the moving body.

Here, the command buttons 75 of the remote control 10-1 include the up button 21, the down button 23, the manipulation button 22, and the emergency stop button 24 illustrated in FIG. 5.

In this embodiment, a microcomputer 73 is also built into the remote control 10-1, and this microcomputer 73 is equipped with a CPU (central processing unit), a memory device such as a RAM or ROM, and an input/output (I/O) device, similarly to the microcomputer 25. A piezoelectric gyro 91 and a geomagnetic sensor 95 are also built into the remote control 10-1, and bearing in which the remote control 10-1 is facing is detected by the piezoelectric gyro 91 from the turning of the remote control 10-1 by the operator.

Furthermore, in this embodiment, there is provided a reference position adjuster 70.

Specifically, a reference signal generator 71 is provided that emits reference signals at a directive from the movement control device 42 side. The reference signals from this reference signal generator are received by a reference signal receiver 72 in the remote control 10-1. A signal received by the reference signal receiver is inputted through the microcomputer 73 to a reference position setting component 76, errors in position information found by the piezoelectric gyro and the geomagnetic sensor 95, such as the direction, orientation, and so forth of the remote control 10-1, are corrected, the reference position is found, and after the reference position has been set, the remote control 10-1 issues a drive directive to the trolley 5 or the hook 7.

Figure 14:
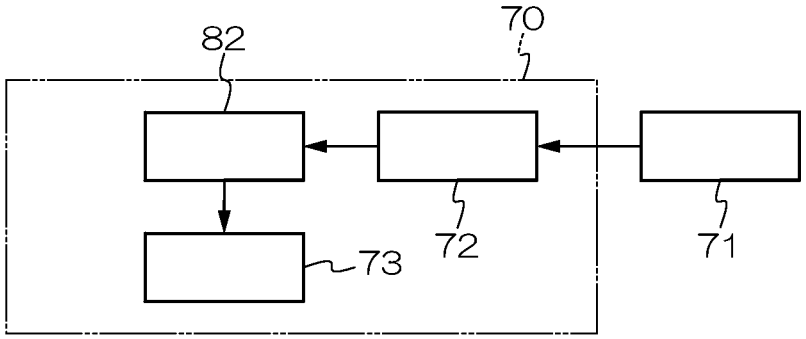
FIG. 14 is a block diagram of a simplified configuration example of a reference position adjustment mechanism of a manipulation apparatus used for an overhead crane serving as the movement apparatus pertaining to another embodiment of the present invention.
Figure 15:
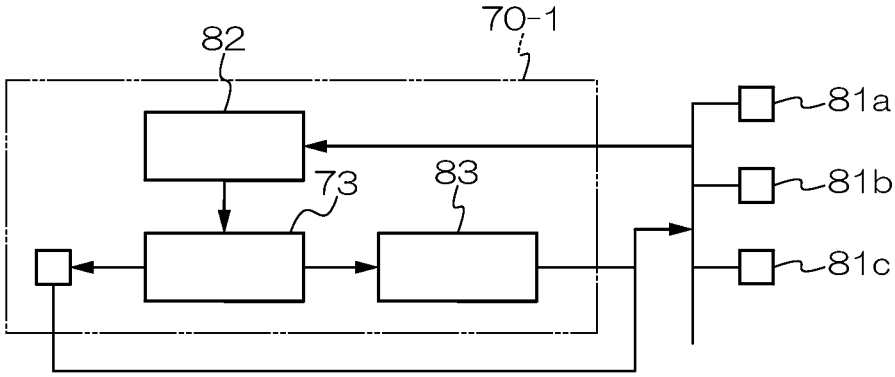
FIG. 15 is a block diagram of another simplified configuration example of a reference position adjustment mechanism of a manipulation apparatus used for an overhead crane serving as the movement apparatus pertaining to another embodiment of the present invention.

The constitution of the reference position adjuster 70 serving as a reference position adjustment mechanism will be described through reference to FIG. 14.

In this drawing, the reference signal generator 71 is specific linear polarization generation means (discussed below), for example. The reference position adjuster 70 comprises the reference signal generator 71 that generates as a reference signal linearly polarized light having a polarization plane with a set orientation, the reference signal receiver 72 that receives reference signals from this reference signal generator 71, a light receiver 82 that receives optical signals taken in by the receiver 72 and produces signals, and the microcomputer 73, sending signals from the light receiver 82 to the microcomputer 73. Receiving directives from the microcomputer 73, the reference position setting component in FIG. 13 can be constituted by an LED lamp or the like. This LED lights when it is confirmed that the remote control 10-1 is disposed in the reference position. This makes it possible to start the manipulation of a travel directive by the remote control 10-1 at this position.

Figure 16:
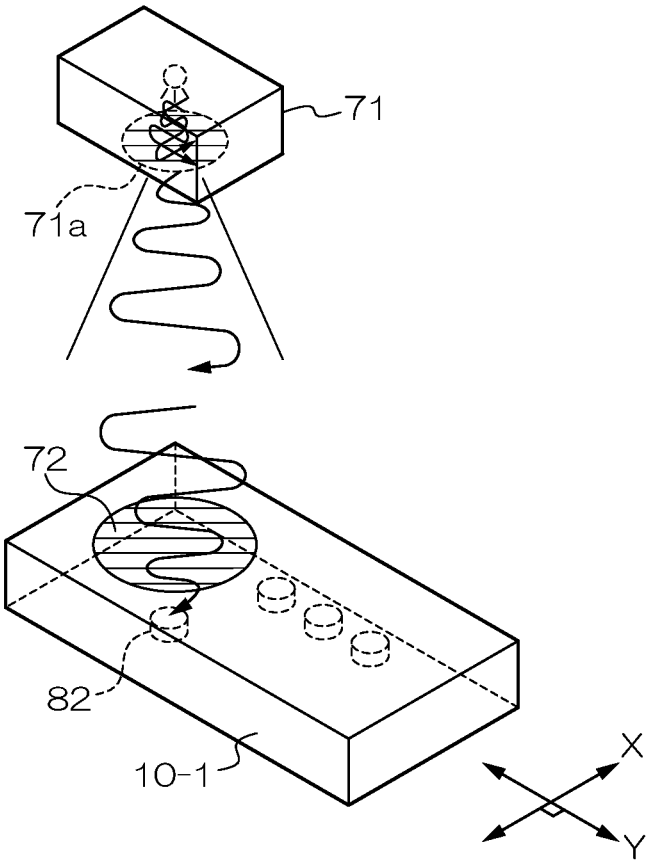
FIG. 16 is a diagram schematically illustrating the configuration of a reference position adjustment mechanism of the manipulation apparatus pertaining to another embodiment of the present invention.

Specifically, as shown in FIG. 16, the reference signal generator 71 is disposed on the Y direction rail 4 or the crane X direction rails 2A and 2B in FIG. 1, for example, and shines light downward as a reference signal. In this case, the reference light emitting component is provided with a polarizing filter 71*a*, for example, and light from a light source (not shown) at the rear, or natural light, is converted into linearly polarized light having its polarization plane in the Y direction.

A filter 72 that transmits only linearly polarized light in the Y direction is disposed on the outer face of the remote control 10-1, and when transmitted light is incident on the light receiving element 82, an electrical signal is produced by opto-electrical conversion, and this electrical signal is sent to the microcomputer 73.

Figure 17:
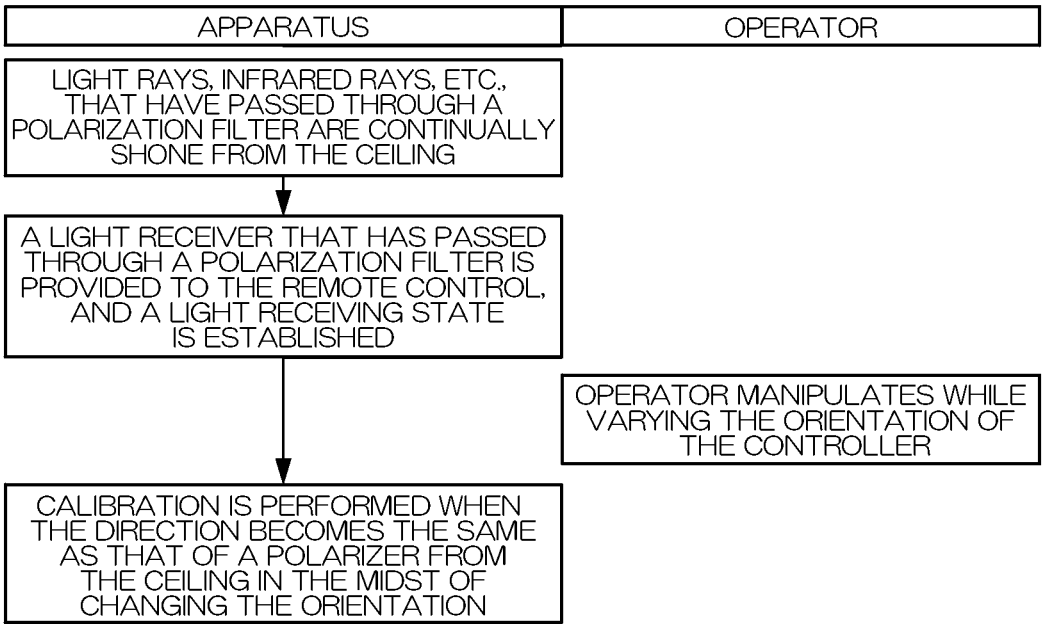
FIG. 17 is a time chart illustrating a simplified view of the method for reference position adjustment of the reference position adjustment mechanism of the manipulation apparatus pertaining to another embodiment of the present invention.

This process is as shown in FIG. 17, and on the apparatus side, linearly polarized light is emitted from the reference signal generator 71 near the ceiling, and the remote control 10-1 is provided with a filter that passes only linearly polarized light, and a light receiving element that receives transmitted light. The operator varies the orientation of the remote control under the crane while waiting for the LED to come on as the above-mentioned reference position setting component.

Figure 18:
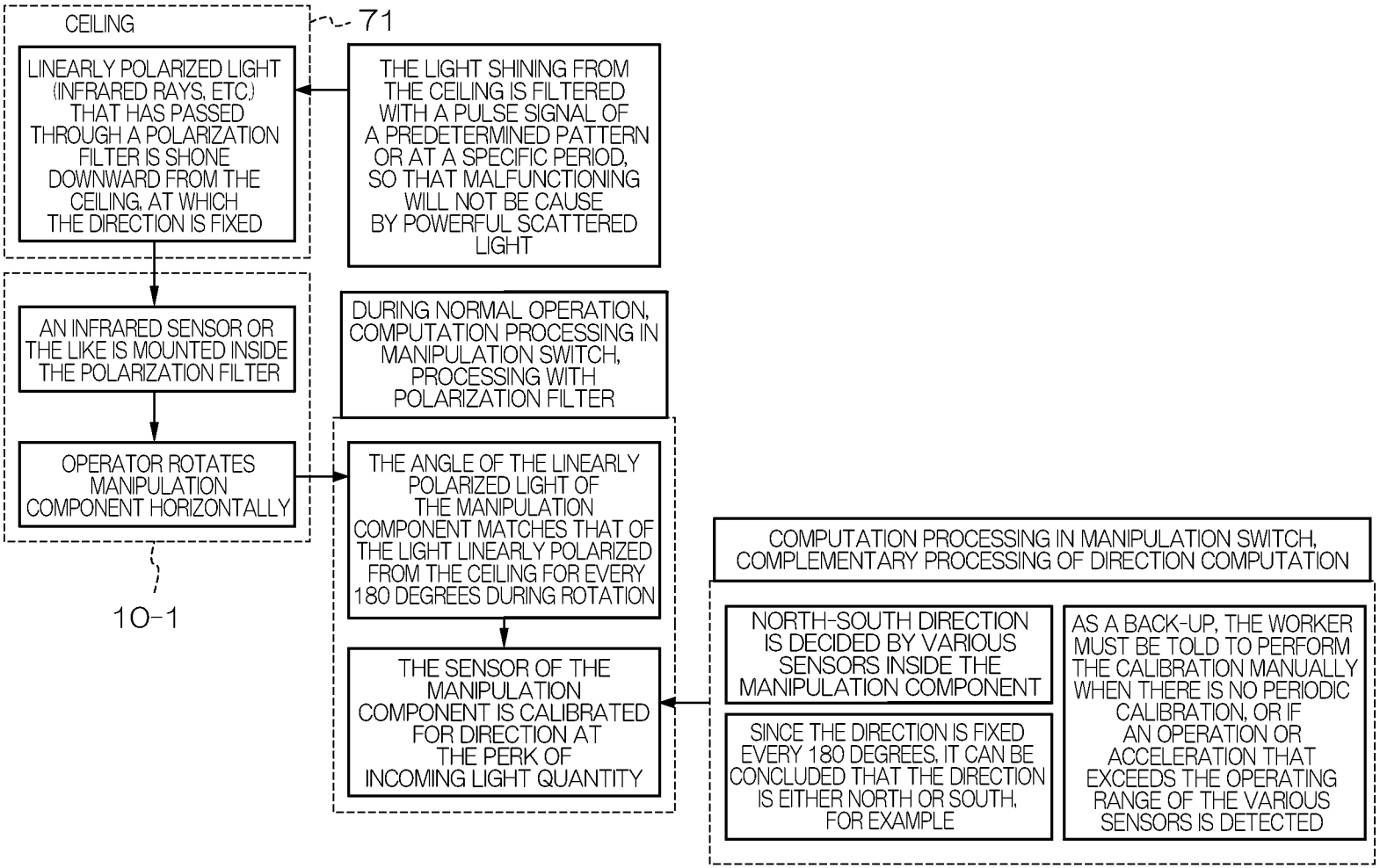
FIG. 18 is a flowchart of the processing of various constituent components in the execution of reference position adjustment by the reference position adjustment mechanism of the manipulation apparatus pertaining to another embodiment of the present invention.

FIG. 18 illustrates this procedure in further detail. The reference signal generator is preferably one that makes use of a light source that emits light under pulse control. Noise caused by stray light such as external scattered light can be removed if the microcomputer 73 on the remote control 10-1 side is designed to set the reference position by means of signals with a specific pulse period.

The operator can set the reference position when the remote control 10-1 is rotated horizontally along the Y direction (see FIG. 16) until its orientation matches the polarization plane of the reference light. In this case, there is a signal strength peak very 180 degrees of rotation of the light receiver, but the north-south direction, etc., can be easily determined by the built-in gyro 91 shown in FIG. 13, for example.

The microcomputer 73 of the remote control 10-1 has built-in clock means (timer) that can make sure that the manipulation directive from the remote control is always accurate by notifying the operator of the movement of the remote control 10-1 with flashing of the LED lamp 76, etc., during periodic calibration, that is, when there is no reference position setting.

Figure 19:
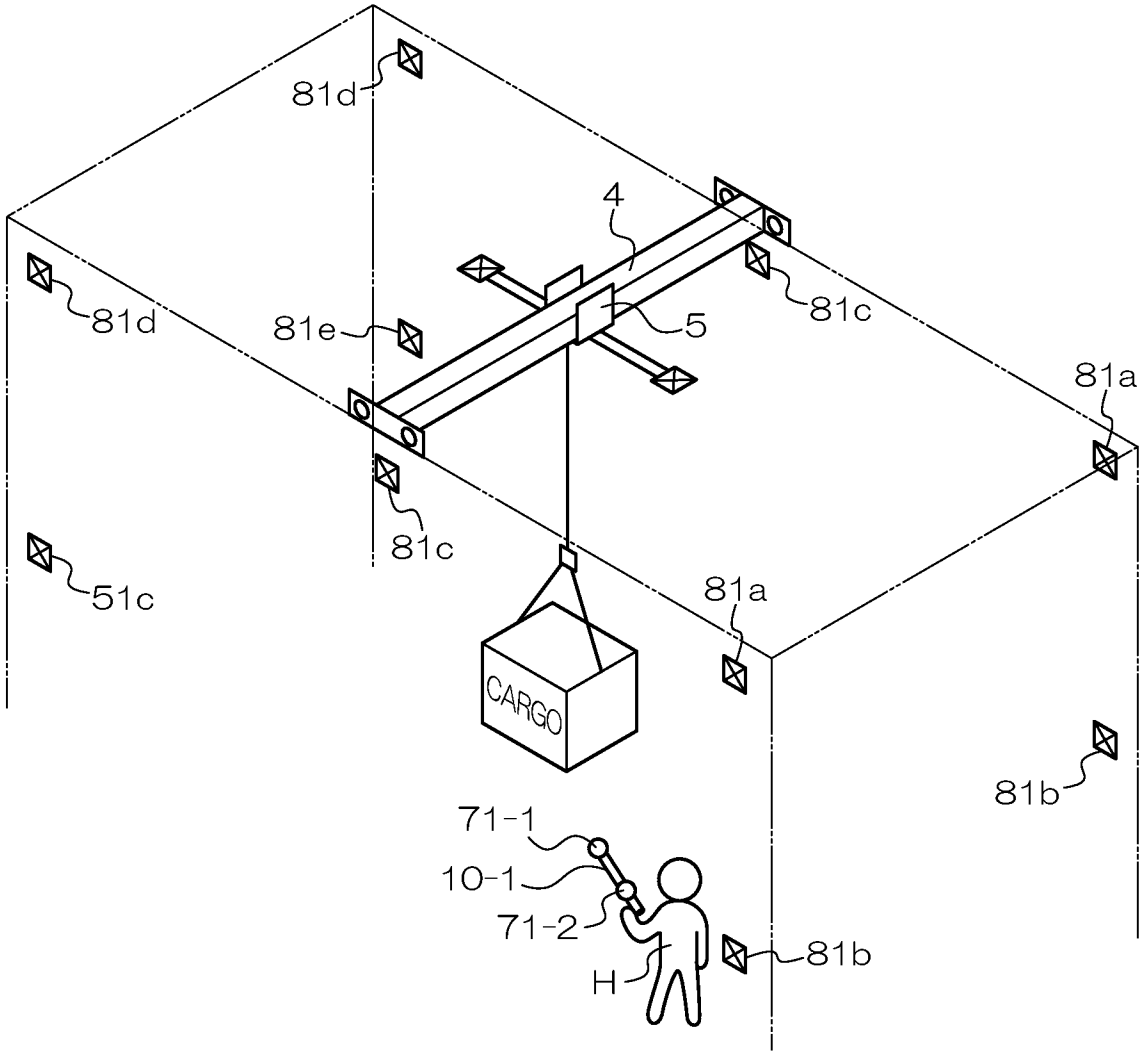
FIG. 19 is a simplified view of another configuration of the reference position adjustment mechanism of the manipulation apparatus pertaining to another embodiment of the present invention.
Figure 20:
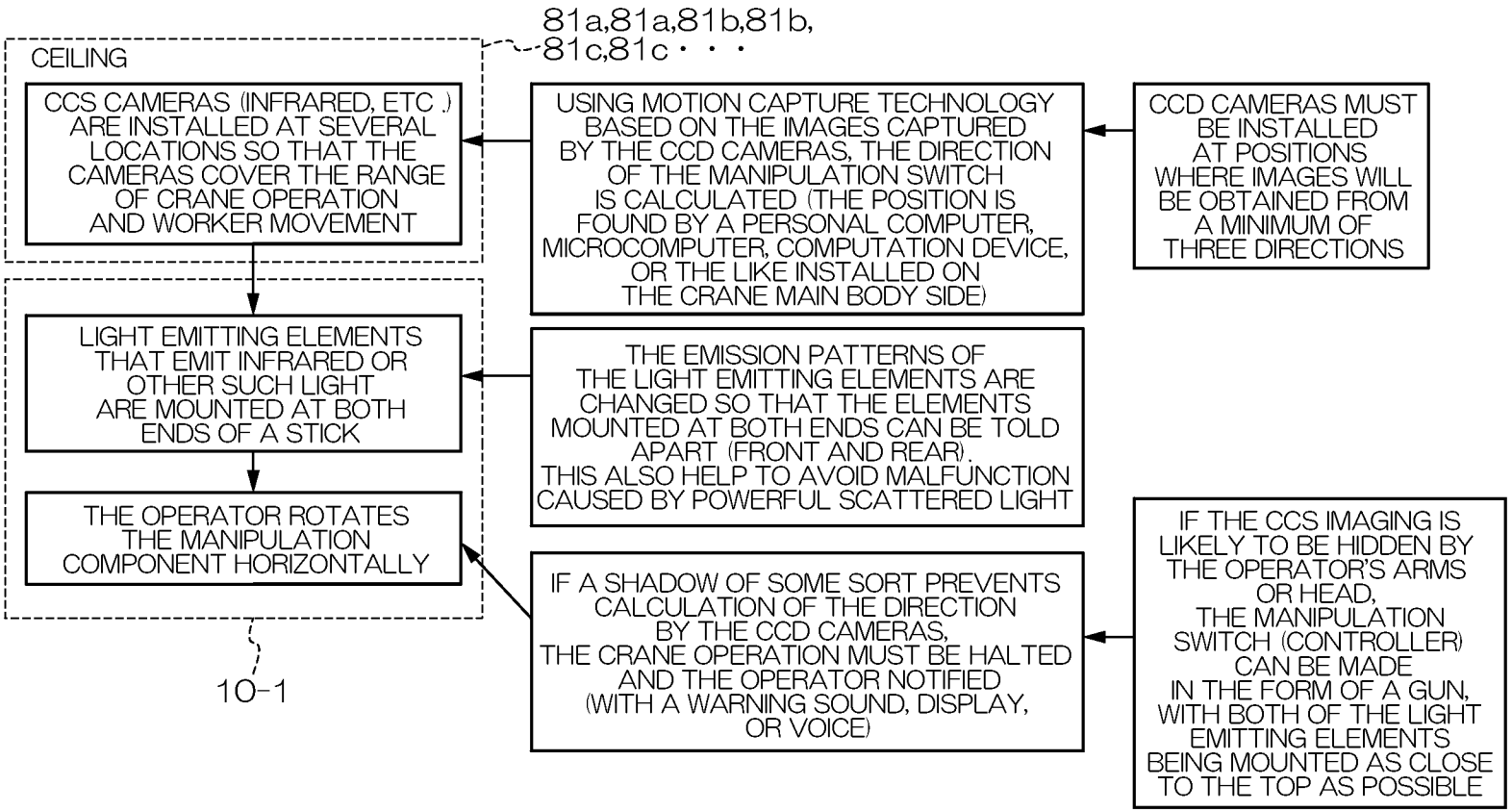
FIG. 20 is a flowchart of the processing of various constituent components in the execution of reference position adjustment with another configuration of the reference position adjustment mechanism of the manipulation apparatus pertaining to another embodiment of the present invention.

FIG. 19 is a simplified view of another configuration of the reference position adjuster 70, and FIG. 20 is a diagram illustrating this.

In this case, the remote control 10-1 has a shape that is longer in one direction. Reference signal generators 71-1 and 71-2 are disposed on the outer face of the remote control 10-1, at places that are a specific distance apart. More specifically, the reference signal generator in this case is a light emitting element, a color generator of a specific color, a component of a specific shape, etc.

A plurality of sets, and preferably three or more sets, of reference signal receivers 81*a*, 81*a*, 81*b*, 81*b*, 81*c*, 81*c*, . . . , are disposed in the room in which the overhead crane is installed.

These reference signal receivers in this case are CCDs (charge coupled devices).

As already described, when the remote control 10-1 and the controller side of a drive device of a crane or the like that receives directives from the remote control 10-1 are at places separated without contact between the components, the remote control 10-1 specifies its own position autonomously by means of the gyro 91 or the like, and a command for movement is issued wirelessly, etc., on the basis of this specified position.

However, if the position of the remote control 10-1 continually changes because the operator is carrying around the remote control 10-1, there will be offset in the specification of the position of the remote control 10-1, so the proper movement directive cannot be made by the controller.

In view of this, as shown in FIGS. 19 and 20, a plurality of sets of CCDs 81*a*, 81*a*, 81*b*, 81*b*, 81*c*, 81*c*, . . . , are provided, for example, as the reference signal receivers (see FIG. 13) at a number of places within the facility. Preferably, three or more sets of CCDs are provided. This is so images can be taken from a minimum of three directions.

The remote control 10-1 in this case is preferably in a form that is longer in one direction to the extent that it is not inconvenient to carry around. For example, a pistol shape comprising a grip and a longer main body that is perpendicular to this grip is favorable. The reference signal generators 71-1 and 71-2, such as light emitting elements, are provided at both ends of this longer main body. It is preferable if the light emitting elements have different emission patterns, or different emission intensities, so that it will be easier to tell the images apart.

Consequently, the microcomputer 73 finds the positions of the reference signal generators 71-1 and 71-2 by a motion capture method, and measures the distance of orientation of an imaginary line that links these generators, and thereby corrects the numeric value of the built-in gyro 91, adjusts the reference position, and allows the reference position to be set.

Third Embodiment

Figure 21:
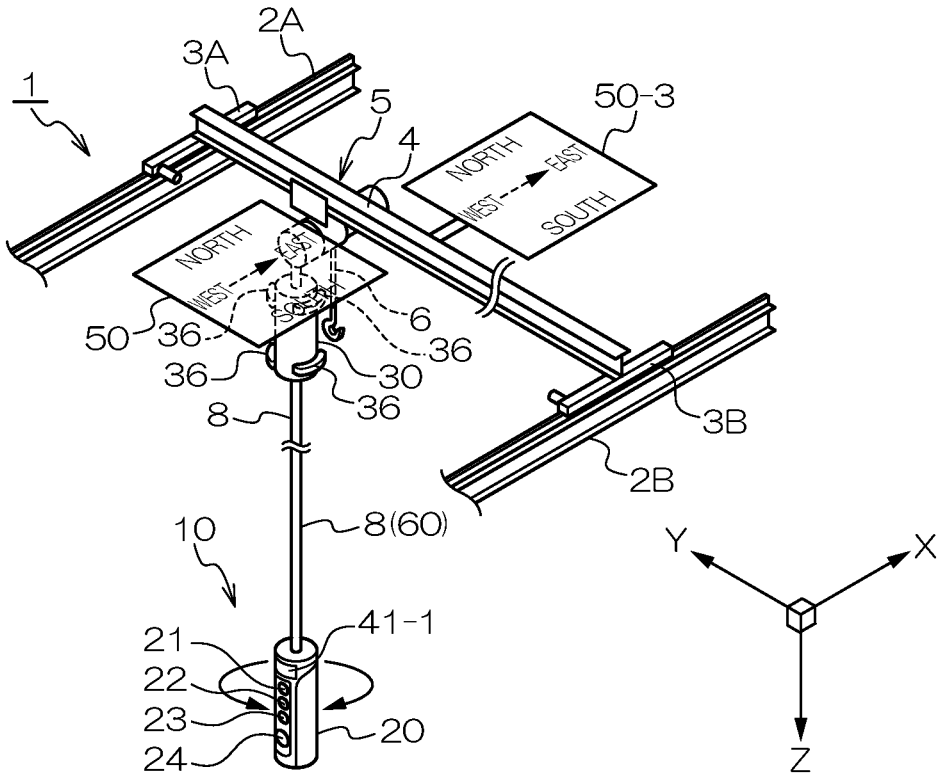
FIG. 21 is an oblique view of the overall configuration of an overhead crane serving as the movement apparatus pertaining to another embodiment of the present invention.
Figure 22:
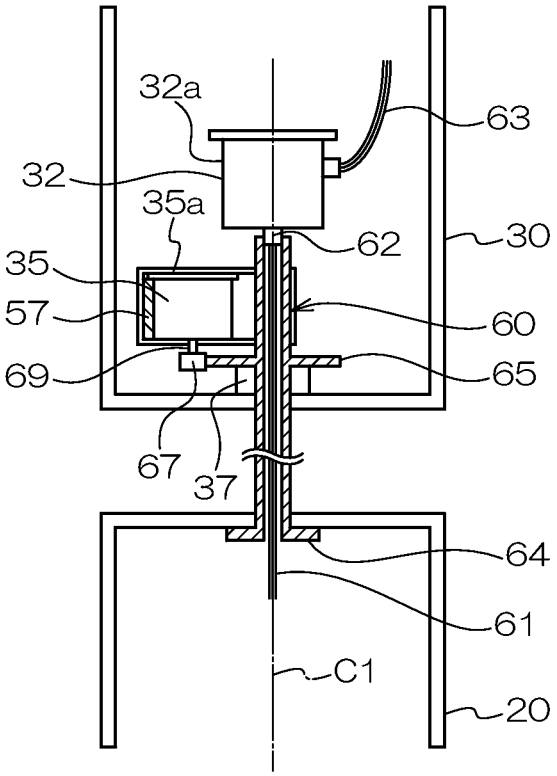
FIG. 22 is a partially enlarged cross section of an internal configuration example of the housing portion of the manipulation apparatus used favorably in an overhead crane serving as the movement apparatus pertaining to an embodiment of the present invention.

FIG. 21 shows a third embodiment of an overhead crane as an example of the movement apparatus pertaining to the present invention. FIG. 22 is a partially enlarged cross section of an example of the internal configuration of the housing portion of a manipulation apparatus used favorably in the overhead crane of FIG. 21.

In these drawings, those components that are numbered the same as in FIG. 1 or 2 share the same constitution, so redundant descriptions will be omitted or quoted, and the following description will focus on the differences.

In this embodiment, as shown in FIG. 21, the second housing 30 is disposed near the ceiling and far away from the first housing 20, which is at the position of the operator.

As shown in FIG. 21, the first housing 20 and the second housing 30 are linked by the tubular component 60, into which is inserted a signal cable along a vertical turning shaft.

Specifically, when the movement apparatus is an overhead crane, the second housing is fixed to a hoist serving as the trolley 5. The first housing 20 is connected to a long tubular component 60 that hangs down from the second housing 30 as shown in FIG. 22, and undergoes turning displacement as indicated by the arrow in FIG. 21 along with the tubular component 60 according to the movement of the operator's hand. This movement is detected by a rotary encoder 35 of the second housing 30, just as in the first embodiment, and the detection signal is sent by the slip ring 32 from a signal wire 63 to a drive controller.

Also, as shown in FIG. 21, an indicator 41-1 is provided to the first housing 20 in a region above the region where the manipulation buttons are disposed, for example. The indicator 41-1 is designed so that the same indication is displayed by incorporating a small liquid crystal display device or the like, in synchronization with the display component 50 that shows the direction. The indicator 41-1 is not limited to being a liquid crystal display, and can also be formed by using El, LED, a photocell or any of various other display means.

Thus, with this third embodiment, the second housing 30 is disposed above and away from the first housing 20.

Accordingly, the only thing the operator holds and uses is the first housing 20, so the remote control can be made more compact, lighter, and easier to handle. Furthermore, the rotary encoder 32 and other such precision parts need not be provided to the first housing 20, which is continually being carried and moved around, so they are more resistant to impact and the like from the outside, and are tough enough to withstand extended use.

Also, because the second housing 30 is disposed above the first housing 20, such as near the ceiling, precision measurement devices that are relatively susceptible to impact from the outside, such as the rotary encoder 32, can be safely installed and held.

Figure 23:
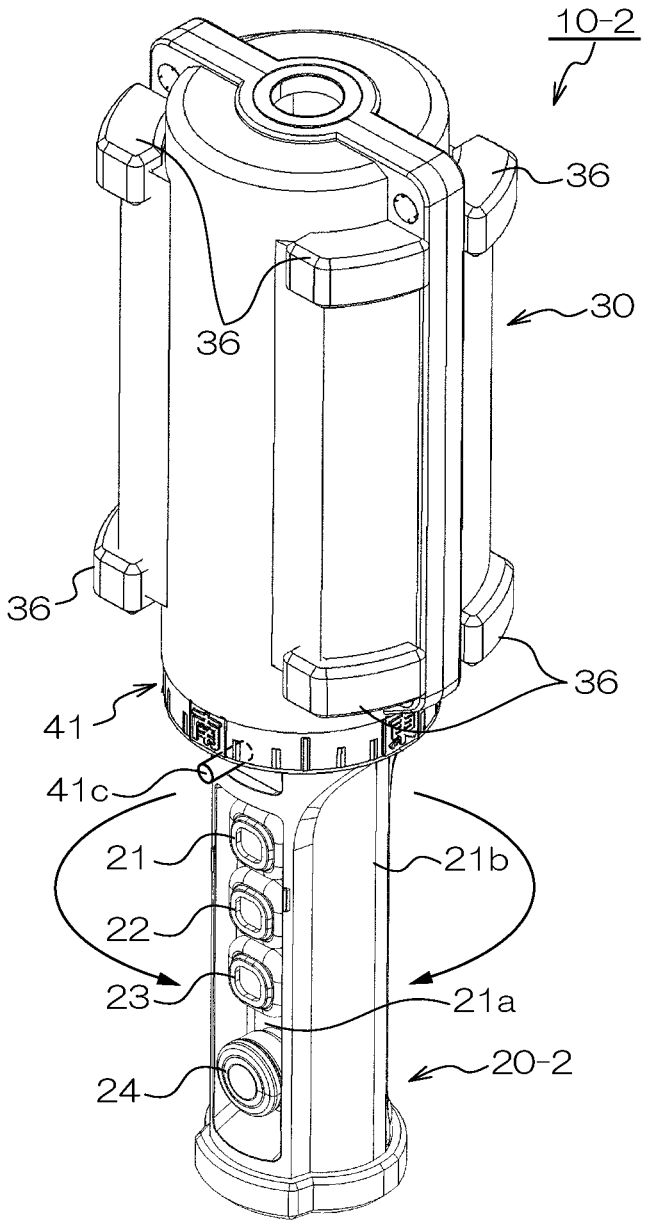
FIG. 23 is a simplified oblique view of the manipulation apparatus (second modification example) pertaining to another embodiment of the present invention.
Figure 24:
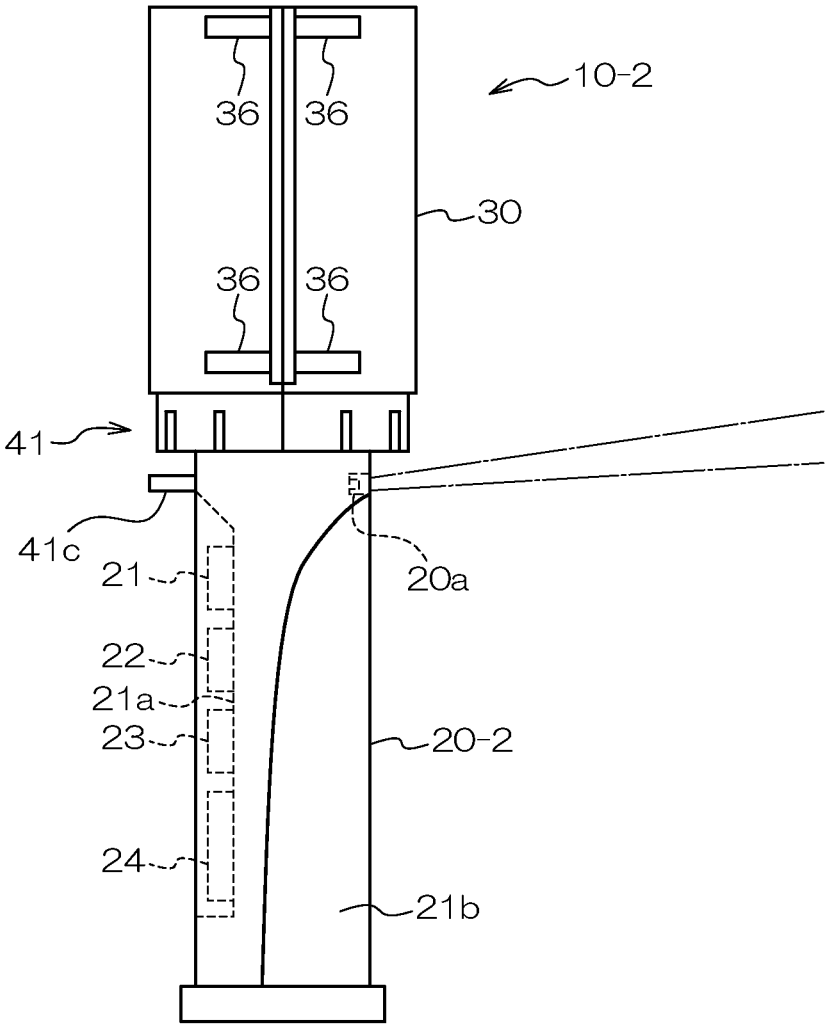
FIG. 24 is a simplified side view of the manipulation apparatus (second modification example) pertaining to another embodiment of the present invention.

FIGS. 23 and 24 are, respectively, a simplified oblique view and a simplified side view a second modification example of the manipulation apparatus pertaining to the present invention. In these drawings, those components that are numbered the same as in FIG. 3 or 8 share the same constitution, so redundant descriptions will be omitted or quoted, and the following description will focus on the differences.

With the remote control 10-2 serving as manipulation apparatus in this second modification example, a first housing 20-2 and a second housing 30 are formed in a cylindrical shape, either hollow or solid. The first housing 20-2 and the second housing 30 have outside diameters that are different from each other, and the outside diameter of the first housing 20-2 is smaller than the outside diameter of the second housing 30.

Also, in this case the first housing 20-2 and the second housing 30 are configured such that the bottom faces of the bottomed cylinders illustrated in FIG. 9 are opposite each other, but other configurations are also possible, and the first housing 20-2 can be partially incorporated into the larger second housing 30.

Cross sections of the first housing 20-2 and the second housing 30 (cross sections perpendicular to the rotational axis of the relative turning) do not have the same diameter near the portion where the components are apparently in contact, but both are circular in shape. In this situation, the housing with the larger cross section (the second housing 30) may cast a shadow on the surface of the other housing (the first housing 20-2), but this shadow is uniform, with no difference in the darkness or length in the shadow, so a situation in which the information indicated by the indicator 41 disposed on the surface of the other housing surface is difficult to read will be unlikely to occur.

Preferably, there is a marker 41*c*, which shows the current turning position of the second housing 30 with respect to the indicator 41, at the upper end of the first housing 20-2, that is, at a location that is in close contact with the first housing 20-2.

Specifically, the first housing 20-2 can turn with respect to the second housing 30 as indicated by the arrows in FIG. 23, and since the marker 41*c* is fixed to the first housing 20-2, it moves in the turning direction along with the first housing 20-2.

In the case illustrated in FIG. 23, the outside diameter of the first housing 20-2 is smaller than the outside diameter of the second housing 30, so the marker 41*c* is in the form of an indicator needle-like pin that extends a specific length outward in the radial direction from near the exposed upper end of the first housing 20-2. The marker 41*c* is not limited to having this slender cylindrical or pin shape, and can instead be in the form of a triangular column, a polyhedral column, a triangular cone, a polyhedral cone, or another such shape, and can also be a bent indicator needle that is bent midway at a specific angle, such as 90 degrees.

The distal end of the marker 41*c* is in close proximity to the letters, marking, or needle of the indicator 41 in order to be easier to read. Also, even if the second housing 30 casts a shadow on the surface of the first housing 20-2, the operator can still see the indicator 41 without his vision being blocked.

Because of the above constitution, advantages to the remote control 10-2 are that the first housing 20-2 can be made more compact, so it is easier for the operator to grasp and handle.

The scope of the present invention is not limited to the embodiments given above. Also, the above embodiments may be combined with each other, or part thereof may be omitted in their combination. Furthermore, other technological elements not described here can also be combined.

The invention claimed is:

1. A manipulation apparatus capable of directing an operation of a drive device utilized in movement of an object by changing a turning amount and turning direction of relative turning between a first housing and a second housing, wherein a ring-shaped indicator extending around an entire outer circumference of at least one of the first housing or the second housing is provided proximate to an area in which the first housing abuts the second housing, the ring-shaped indicator comprises a plurality of externally visible markings distributed at spaced intervals around substantially an entire circumference of the ring-shaped indicator, and the plurality of externally visible markings provides information related to the turning amount and turning direction of the relative turning, and wherein the second housing is unrotatably fixed to a communication cable which sends the information, and a turning detector is in the second housing.

2. A movement apparatus, comprising a drive device utilized in movement of an object, and a manipulation apparatus capable of directing an operation of the drive device utilized in the movement of the object by changing a turning amount and turning direction of relative turning between a first housing and a second housing, wherein a ring-shaped indicator extending around an entire outer circumference of at least one of the first housing or the second housing is provided proximate to an area in which the first housing abuts the second housing the ring-shaped indicator comprises a plurality of externally visible markings distributed at spaced intervals around substantially an entire circumference of the ring-shaped indicator, and the plurality of externally visible markings provides information related to the turning amount and turning direction of the relative turning, wherein a display component for displaying a direction of movement of the object or the information related to the turning amount and turning direction of the relative turning is provided at a place within a field of vision of an operator other than the manipulation apparatus, and at least part of a display on the display component changes in synchronization with a change in indication by the ring shaped indicator, and wherein the second housing is unrotatably fixed to a communication cable, and a turning detector is in the second housing.

3. The movement apparatus according to claim 2, wherein the drive device comprises an X direction rail disposed in an X direction above the field of vision of the operator, a Y direction rail that is disposed in a Y direction perpendicular to the X direction and moves along the X direction rail, and a trolley that can move along the Y direction rail and can move an object in a Z direction perpendicular to both the X and Y directions, and the display component is disposed on the trolley or the Y direction rail.

4. The movement apparatus according to claim 3, wherein the X direction rail comprises a pair of rails disposed in parallel to each other, and the display component is disposed between the pair of rails.

5. The movement apparatus according to claim 2, wherein a reporting component for reporting a direction of operation of the drive device directed by the operator is provided to a face of the first housing and/or the second housing which is located on an opposite side from a side proximate to the operator when the operator holds the first housing.

6. The movement apparatus according to claim 5, wherein the reporting component comprises a lighting device for lighting the direction of operation of the drive device directed by the operator.

7. The movement apparatus according to claim 2, comprising a signal producing element that is provided at a place apart from and not in contact with the manipulation apparatus and that produces a reference signal that is matched to a specific position and/or direction of the manipulation apparatus, and a reference position adjuster that receives a reference signal produced by the signal producing element and that performs adjustment of a reference position and/or reference direction when the manipulation apparatus is in the specific position and/or direction.

8. The movement apparatus according to claim 2, wherein the manipulation apparatus is provided with a plurality of signal producing element, wherein each signal producing element of the plurality of signal producing elements produces a reference signal and is disposed a specific distance apart from each other signal producing element of the plurality of signal producing elements, and wherein the movement apparatus further comprises a reference position constituting component that comprises three or more signal receivers each detecting a reference signal produced by at least one signal producing element of the plurality of signal producing elements, wherein each signal receiver of the three or more signal receivers is disposed apart from each other signal receiver of the three or more signal receivers at places that are apart from and not in contact with the manipulation apparatus, and the movement apparatus additionally comprises a computer for computing a position and/or direction of the manipulation apparatus on a basis of reference signals detected by the three or more signal receivers.

9. The manipulation apparatus according to claim 1, wherein at or near a place where the ring-shaped indicator is provided, the first housing and the second housing have substantially a same diameter around a turning axis of the relative turning, and/or the first housing and the second housing have a substantially circular cross section perpendicular to the turning axis of the relative turning.

10. The manipulation apparatus according to claim 9, wherein at least one impact reduction member is provided on an outer surface of the second housing.

11. The manipulation apparatus according to claim 1, wherein the first housing and the second housing include respective end surfaces perpendicular to a turning axis of the relative turning, and an end surface of the first housing is opposing and in close proximity to an end surface of the second housing, wherein the opposing end surfaces of the first housing and the second housing have substantially a same diameter around the turning axis of the relative turning and/or the opposing end surfaces of the first housing and the second housing are substantially cylindrical in form.

12. The manipulation apparatus according to claim 1, wherein the first housing and the second housing include respective end surfaces perpendicular to a turning axis of the relative turning, and an end surface of the first housing is opposing and in close proximity to an end surface of the second housing, wherein the opposing end surfaces of the first housing and the second housing have substantially a same diameter around the turning axis of the relative turning and/or the opposing end surfaces of the first housing and the second housing are substantially cylindrical in form, and wherein the ring-shaped indicator is provided on at least one of an outer surface of the first housing or an outer surface of the second housing.

13. The manipulation apparatus according to claim 1, wherein the first housing and the second housing include respective end surfaces perpendicular to a turning axis of the relative turning, and an end surface of the first housing is opposing and in close proximity to an end surface of the second housing wherein the first housing and the second housing are formed in a substantially cylindrical shape, the first housing and the second housing have outside diameters that are different from each other, and the outside diameter of the first housing is smaller than the outside diameter of the second housing, and wherein the ring-shaped indicator is provided on at least one of an outer surface of the first housing or an outer surface of the second housing.

14. The manipulation apparatus according to claim 13, wherein at least one impact reduction member is provided on the outer surface of the second housing.

15. The manipulation apparatus according to claim 1, wherein the manipulation apparatus is configured for a crane controller.

16. The manipulation apparatus according to claim 1, wherein an entirety of one of the first housing or the second housing is vertically arranged above the other of the first housing or the second housing.

17. The movement apparatus according to claim 2, wherein an entirety of one of the first housing or the second housing is vertically arranged above the other of the first housing or the second housing.

* * * * *